US006547034B1

(12) United States Patent
Waters

(10) Patent No.: US 6,547,034 B1
(45) Date of Patent: Apr. 15, 2003

(54) PRUNING SYSTEM

(76) Inventor: David Waters, 10381 Major Rd., Yuba City, CA (US) 95991

( * ) Notice: Subject to any disclaimer, the term of this patent is extended or adjusted under 35 U.S.C. 154(b) by 0 days.

(21) Appl. No.: 08/475,026

(22) Filed: Jun. 6, 1995

Related U.S. Application Data

(63) Continuation of application No. 07/986,477, filed on Dec. 7, 1992, now Pat. No. 5,427,197.

(51) Int. Cl.[7] ..... B66F 11/04
(52) U.S. Cl. ..... 182/62.5; 182/63.1
(58) Field of Search ..... 182/63, 141, 148, 182/2, 62.5, 63.1, 69.4, 69.6

(56) References Cited

U.S. PATENT DOCUMENTS

| | | | | | |
|---|---|---|---|---|---|
| 1,718,979 | A | | 7/1929 | Protzeller | |
| 2,450,812 | A | | 10/1948 | Ray | 304/9 |
| 2,601,092 | A | | 6/1952 | Cardiff | 214/83.1 |
| 2,616,768 | A | | 11/1952 | Stemm | 304/9 |
| 2,778,694 | A | | 1/1957 | Mitchell | 304/29 |
| 3,016,973 | A | * | 1/1962 | Williamson | 182/148 X |
| 3,085,650 | A | * | 4/1963 | Merk | 182/148 X |
| RE25,746 | E | | 3/1965 | Gregory | 182/141 |
| 3,191,717 | A | | 6/1965 | Kazuo Hiyama | 182/131 |
| 3,311,191 | A | | 3/1967 | Kazuo Hiyama | 182/131 |
| 3,337,000 | A | * | 8/1967 | Giladl | 182/148 |
| 3,529,696 | A | * | 9/1970 | Jacobsen | 182/148 X |
| 3,537,236 | A | | 11/1970 | Fridley | 53/391 |
| 3,641,738 | A | | 2/1972 | Johnson | 53/391 |
| 3,791,484 | A | | 2/1974 | Harrison | 182/2 |
| 3,866,713 | A | | 2/1975 | Carpenter et al. | 182/2 |
| 4,546,852 | A | * | 10/1985 | Martin | 182/62.5 |
| 4,643,273 | A | | 2/1987 | Stokoe | 182/2 |
| 5,107,955 | A | | 4/1992 | Kishi | 182/2 |
| 5,113,969 | A | * | 5/1992 | Drolet | 182/2 |
| 5,159,989 | A | | 11/1992 | Claxton | 180/41 |

FOREIGN PATENT DOCUMENTS

| | | | | |
|---|---|---|---|---|
| FR | 2384437 | * | 11/1978 | 182/141 |

OTHER PUBLICATIONS

Woods Manufacturing, Inc.; "The Tree Squirrel" brochure; no date; entire brochure.

Dakota "AG" Welding, Inc.; "Prune–Rite Pruning Towers" brochure; no date; entire brochure.

Weldcraft Industries, Inc.; no title; no date; entire brochure.

* cited by examiner

*Primary Examiner*—Alvin Chin-Shue
(74) *Attorney, Agent, or Firm*—Bernhard Kreten

(57) ABSTRACT

A pruning vehicle having characteristics specifically utilizable in an orchard having rows of trees opposite each other. The vehicle is equipped with two platforms side by side which can be adjustably located vertically and horizontally in a plane perpendicular to the direction of the vehicle's motion. Each platform is controllable by an operator standing upon the platform through foot pedals incorporated thereon. Platforms are elevated above the vehicle by lifting structures designed to keep the platforms level to the ground at all times. The platforms are connected to a frame of the vehicle at a low slung central portion of the frame for added stability. Wheels of the vehicle are of a thin disc shape. Each wheel can slice through soft surfaces such as mud to attain a firm foundation for the pruning vehicle. Fins and teeth on the wheels provide added traction. Mud deflectors on the wheels prohibit mud from climbing up too high onto or bogging down the pruning vehicle. The wheels are powered by hydraulic motors which are powered by an engine mounted upon the frame of the vehicle. The engine also powers hydraulic rams which steer all four wheels of the vehicle and adjust the locations of the platforms. The motion and steering of the pruning vehicle is controllable from one of the platforms, eliminating the need for an additional operator on the vehicle to drive the pruning vehicle. One form of the invention links vertical motion of the platforms together while preserving independent horizontal motion of the platforms. In this embodiment the platforms are connected by a walkway allowing operators to pass between the platforms on opposite sides of the pruning vehicle without climbing off of or lowering the platforms.

21 Claims, 15 Drawing Sheets

PRUNING SYSTEM

CROSS-REFERENCE TO RELATED APPLICATIONS

This application is a continuation of U.S. patent application Ser. No. 07/986,477 filed Dec. 7, 1992, now U.S. Pat. No. 5,427,197.

FIELD OF THE INVENTION

The following invention relates to vehicles, platforms and other systems for use in orchards to prune trees. More specifically, this invention relates to vehicles having vertically and horizontally adjustable platforms for locating workers close to the trees to be pruned.

BACKGROUND OF THE INVENTION

Throughout the history of agriculture, the financial success of the farmer has depended considerably on how efficiently and cost effectively the farmer could produce his crop. Whenever devices improve the efficiency with which the farmer can perform a required task, the size of crop the farmer can produce is increased. Also, with more efficient machines the farmer requires fewer laborers to produce the crop. Even small improvements in efficiency allow the farmer to increase his productivity, perhaps making a failing farmer into a successful one.

One task required of orchard farmers is that of pruning the trees. The more efficiently the orchard can be pruned, the more time the farmer will have for other tasks and the fewer laborers the farmer will need to hire in order to prune the orchard. Pruning is best accomplished while the trees are dormant or after harvest. Frequently, the terrain in the orchard is inhospitable to machinery at this time because of muddy, bog-like conditions associated with the rainy season.

Many devices exist in the prior art designed to improve the efficiency with which an orchard can be pruned or other tree maintenance tasks may be performed. Some devices require mounting on other vehicles or require that they be towed behind vehicles. Those that are self contained as a vehicle inadequately address the problem of maneuvering through unstable surfaces, such as mud, often prevalent in the orchard environment. These pruning vehicles also require greater numbers of operators for their use.

The invention of this application provides a self contained pruning vehicle designed to easily maneuver through the orchard environment, provide easily controllable access to the trees for pruning, and be operable by a small group of men or even one man alone.

The following prior art reflect the state of the art of which applicant is aware and are included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| U.S. PATENT DOCUMENTS | | |
| Protzeller | 1,718,979 | July 2, 1929 |
| Ray | 2,450,812 | Oct. 5, 1948 |

-continued

| INVENTOR | PATENT NO. | ISSUE DATE |
|---|---|---|
| Cardiff | 2,601,092 | June 17, 1952 |
| Stemm | 2,616,768 | Nov. 4, 1952 |
| Mitchell | 2,778,694 | Jan. 22, 1957 |
| Gregory | Re. 25,746 | March 23, 1965 |
| Kazuo Hiyama | 3,191,717 | June 29, 1965 |
| Kazuo Hiyama | 3,311,191 | March 28, 1967 |
| Fridley | 3,537,236 | Nov. 3, 1970 |
| Johnson | 3,641,738 | Feb. 15, 1972 |
| Harrison | 3,791,484 | Feb. 12, 1974 |
| Carpenter, et al. | 3,866,713 | Feb. 18, 1975 |
| Stokoe | 4,643,273 | Feb. 17, 1987 |
| Kishi | 5,107,955 | April 28, 1992 |
| Claxton | 5,159,989 | Nov. 3, 1992 |
| FOREIGN PATENT DOCUMENTS | | |
| Soyuzgiprostrom | SU 1,416,638 | Aug. 15, 1988 |

Other Prior Art (Including Author, Title, Date, Pertinent Pages, Etc.)

Woods Manufacturing, Inc.; "The Tree Squirrel" brochure; no date; entire brochure.

Dakota "AG" Welding, Inc.; "Prune-Rite Pruning Towers" brochure; no date; entire brochure.

Weldcraft Industries, Inc.; no title; no date; entire brochure.

The Johnson patent teaches the use of a self contained pruning and picking vehicle. This vehicle requires a separate driver and uses standard rubber tires. Platforms on the Johnson device have restricted vertical motion. Some of the platforms do not move vertically at all, while others must move up and down together and cannot work independently. The vehicle of the instant application is operable without a designated driver and has wheels providing greater stability and movement. Furthermore, each platform is able to move independently vertically.

The patent to Stemm teaches a vehicle having two fully independent moveable platforms. The device of the present application is distinguishable from Stemm in that the vehicle may be driven from one of the platforms, has specially modified wheels, and positions the two lifting platforms in a side by side orientation making it more easily utilizable in an orchard environment where trees of adjacent rows are often directly opposite each other.

The patents to Gregory and Cardiff teach various lifting platforms which must be mounted to a separate vehicle to be utilized within the orchard environment. The platforms of the instant application are included in the pruning vehicle and do not necessitate the use of a separate vehicle for motivation.

The patent to Fridley requires the use of stairs for elevational change, while the vehicle of the present application has hydraulically operable platforms for adjustment in elevation.

The remainder of the prior art listed above but not specifically distinguished diverge more starkly from the invention of this application.

SUMMARY OF THE INVENTION

The pruning system is broken down into three major subparts: a chassis, wheels and a scaffold.

The chassis is composed primarily of a rigid frame. The frame has a forward structure, a rearward structure and a central structure. The forward structure has an axle mounted thereto which supports two forward wheels, one on each side of the frame at extremities of the axle. The forward structure also has various fillers for fluids such as oil and gas which are required by an engine located on the rearward structure. The forward structure of the frame is rigidly and fixedly attached to the central structure. The central structure is of a thinner profile, when viewed from the side, than the forward structure or the rearward structure. The central structure is lower in elevation than the forward structure and the rearward structure.

The scaffold is mounted on an upper surface of the central structure. The central structure is rigidly attached to the forward structure by a forward transition structure. The forward transition structure is a substantially vertically oriented rigid member to which the forward structure and the central structure are fixedly attached. By having the scaffold attached to the central structure, and having the central structure lower than the forward structure and the rearward structure, the stability of the pruning vehicle is improved. This allows the pruning vehicle to be narrower and lighter without risking tipping when platforms on the scaffold are extended horizontally and loaded.

The central structure is fixedly attached to the rearward structure by a rearward transitional structure there between. The rearward transitional structure is substantially identical to the forward transitional structure and is fixedly attached to both the central structure and the rearward structure. The engine is mounted above the rearward structure. An engine housing encloses the engine. Below the rearward structure is located an axle to which two wheels are attached.

Both the forward structure and the rearward structure have hydraulic motors integrated therein. These hydraulic motors receive their power from the engine and transmit power to the wheels through differentials interposed on each of the axles.

Also, on both the forward structure and the rearward structure are attached steering rams. Each steering ram is in turn connected on an opposite end to a steering ram tie rod which is attached to the wheel axle interface to turn the wheels. In this way, both forward and rearward wheels of the pruning vehicle are steerable.

Each of the four wheels has a substantially identical structure. These wheels allow navigation in an orchard having unstable ground conditions. The wheels are substantially disc shaped having a circular central hub which is fastenable to the axle. Circumscribing the hub at a perimeter of the wheel is a circular rim. The rim is narrower in width than the width of the hub. A circular disc is interposed between the hub and the rim and is fixedly attached to both the hub and the rim. The disc tapers from having a width similar to the width of the hub at its inner end and having a width similar to the width of the rim at its outer perimeter. Thus, in cross section the wheels taper in a manner similar to an inverted isosceles triangle from being wider near the axle to being thinner at the rim where contact with the ground is made.

A plurality of fins are attached to the discs on both inner and outer surfaces. The fins extend radially outward from the hub toward the rim. The fins are fixedly attached to the disc. The fins prevent the wheels from slipping when operating through soft surfaces. A plurality of side rim teeth extend axially out from the rim. Each tooth extends a distance similar to the width of the rim. The side rim teeth are located on both the inner and outer sides of the rim. The side rim teeth provide further traction for the wheels.

Fixedly attached to the discs on inner and outer surfaces thereof are a plurality of mud deflectors. Each mud deflector extends outwardly from the surface of the disc at an angle which slopes toward an axis collinear with the hub. The wedge shaped cross-section of the wheels allows the wheels to penetrate deeply into soft ground conditions yet not get bogged down. In this way, the wheels contact firmer ground beneath the less firm surface. Thus, the wheels reside on a firm foundation allowing operators on platforms attached to the scaffold to more easily work.

The scaffold of the pruning system elevates users above the vehicle and extends users horizontally away from the vehicle to provide them with better access to the trees to perform pruning and other maintenance. The scaffold is divided into two substantially identical scaffold portions, a left scaffold portion and a right scaffold portion. The lifting apparatus of the left scaffold is oriented closer to the forward structure of the frame of the chassis and the right scaffold's lifting structure is located closer to the rearward structure of the chassis. In this way, the two scaffolds may come quite close to each other without their separate lifting apparatus interfering with each other.

Each lifting apparatus is described as follows. A guide is fixedly attached to the central structure of the frame. Received within the guide is a horizontal slide. The horizontal slide is a rigid construct capable of sliding into and out of the guide in a horizontal direction perpendicular to the direction of vehicle motion. Fixedly attached to the slide on an upper surface thereof and at an end distant from the vehicle is located a base. The base is a rigid unitary mass. Pivotably connected to the base are two rigid links referred to as a lower driver and lower follower. The lower driver and lower follower pivotably attach on an upper end to an intermediate riser.

The intermediate riser is a rigid unitary mass similar to the base. The lower driver and lower follower are oriented such that they are preferably parallel to each other. The lower driver is above the lower follower. Fixedly attached to the lower driver at a point between the intermediate riser and the base is a hydraulic attachment bracket. Attached to the hydraulic attachment bracket is one end of a hydraulic ram. The other end of the hydraulic ram is pivotably attached to the base.

When the hydraulic ram is extended, the lower driver pivots about the base causing the intermediate riser to move upwardly. The lower follower also pivots along with the driver and causes the intermediate riser to elevate without rotating. In this way, the intermediate riser does not rotate in relationship to the base and the attached vehicle. Pivotably attached to the intermediate riser are two upper links referred to as an upper driver and an upper follower. The upper driver is higher than the upper follower.

On ends of the upper driver and upper follower opposite the intermediate riser is pivotably attached an upper riser. The upper riser is in turn fixedly attached to the platform. An upper hydraulic ram is pivotably mounted between the intermediate riser and the upper driver. Thus, when the upper hydraulic ram is extended, the upper driver pivots about the intermediate riser. This causes the upper riser to be elevated. The upper follower is also pivoted and causes the upper riser to elevate without rotation.

By extension of the upper hydraulic ram and lower hydraulic ram, the platform is elevated from a level slightly above the upper surface of the central structure of the frame to a height approximately twice the width of the vehicle.

Fixedly attached to the platform is a cage. The cage extends to an elevation approximately waist high above the platform. The cage allows a worker standing on the platform to work without concern of slipping off of the platform. A door is provided on one side of the cage for entrance and exit from the platform. When the cage is opened the hydraulic rams associated with the scaffold are disabled.

An in/out pedal is provided on the floor of the platform which when depressed causes the hydraulic ram attached to the slide to be extended or contracted. In this way a worker on the platform can cause the platform to move in (towards) and out (away) from the vehicle.

An up/down pedal is also provided on the platform. The up/down pedal is connected to the lower hydraulic ram and the upper hydraulic ram. Thus, when the worker on the platform wishes to move up or down he may depress the pedal appropriately causing the hydraulic rams to be extended or contracted causing the lifting structure to elevate or lower the platform.

One of the two platforms is provided with a steering joystick. The steering joystick is connected to the hydraulic motors which turn the wheels and the hydraulic rams which steer the wheels. Moving the joystick by one of the workers on one of the platforms causes the vehicle to move forward or in reverse and causes the vehicle to turn. In this way, the vehicle is operable without the necessity of having an extra operator to drive the vehicle.

The upper ram on the lifting mechanism of the platform may be replaced by a mechanical link attached to an upper end of the lower driver and a lower end of the upper driver. The mechanical link causes the upper riser to be elevated with respect to the intermediate riser when the lower hydraulic ram is extended. In this way, a single hydraulic ram is able to fully elevate the platform.

A modification of the scaffold has a series of four vertical base sleeves fixedly attached to the central structure of the frame of the chassis. Four base slides are sized to fit within these sleeves. A base ram is interposed between the central structure and a scaffold frame. The scaffold frame is fixedly attached to upper surfaces of the base slides and to the upper end of the base ram. Base sleeve supports extend from the forward structure and rearward structure to upper ends of the base sleeves to provide additional lateral support. When the base ram is extended, the scaffold frame is lifted vertically.

The scaffold frame has fixedly attached thereto a handrail and a walkway. The scaffold also has a left slide guide and a right slide guide thereon. The left slide guide is sized to receive a left slide. The left slide is a horizontally extending rigid construct which is capable of extending horizontally outward away from the vehicle. The right slide is similar in design to the left slide. The right slide is sized to fit within the right guide of the scaffold frame.

Cages are fixedly attached to upper surfaces of the slides on ends most distant from the vehicle. The cages have handrails which extend into the handrail fixedly attached to the scaffold frame. Each slide has a hydraulic ram interposed between itself and the scaffold frame. When the hydraulic rams are extended, the slides extend, thereby positioning the cages at a distance farther away from the vehicle in a horizontal direction. The cage handrails also extend while remaining within the fixed handrail on one end. Each cage has a moving walkway fixedly attached at a lower end thereof which slides under the fixed walkway when the cage is extended. The two moving walkways along with the fixed walkway form a single continuous platform between the left cage and the right cage.

Each cage has pedals which allow a worker to extend the cage toward and away from the scaffold frame in a horizontal direction perpendicular to vehicle motion. One of the cages has an additional pedal which activates the base ram causing the scaffold to be elevated or lowered. The steering joystick is connected to one of the cages for steering and driving of the vehicle by a worker within one of the cages. In this modification the vehicle is operable by a single worker having easy access to both left and right cages simultaneously.

An alternative modification to the vehicle which has the central scaffold utilizes an identical scaffold frame with identical handrail and walkway and left and right cages. This alternative version of the scaffold, however, is attached to the central structure through a series of scissor links.

In this modification, fixedly attached to the central structure is a forward and a rearward base guide. Rolling within the two base guides are guide wheels. Each guide wheel is pivotably attached to a lower end of a lower scissor link. One end of the base guides has lower ends of scissor links pivotably attached directly thereto. The four lower scissor links are pivotably attached to each other in pairs at a location directly above each base guide. Upper ends of the lower scissor links are pivotably attached to lower ends of upper scissor links which in turn are pivotably attached to each other in a middle portion and pivotably attached to the scaffold frame on upper ends thereof. Some of the upper scissor links' upper ends are pivotably attached to a guide wheel which rolls within a scissor scaffold guide fixedly attached to the lower surface of the scaffold frame. The other upper ends of the upper scissor links are pivotably attached directly to the scissor scaffold guide.

A hydraulic ram is pivotably attached between the base guide and one of the lower scissor links. When the hydraulic ram is extended, the scissor links are pivoted and the guide wheels within the base guide and the scissor scaffold guide roll toward a middle of the base guide and the scissor scaffold guide. The scissor scaffold guide is pivotably attached directly to a scissor link. This causes the scaffold frame to be elevated without rotation. The hydraulic ram is controllable by a pedal located on the scaffold.

This modification allows for passage of a worker between the two cages without lowering of the scaffold. This modification also allows a single worker to operate the entire vehicle and maintain two trees at the same time without moving the pruning vehicle chassis.

Other alternative modifications to the scaffold include providing two separate scaffolds for each cage, the scaffolds utilizing a mechanism similar to that common in forklifts. Each scaffold in this modification has a horizontal extension mechanism with a vertical extension mechanism on a distant end of the horizontal extension mechanism. The two side-by-side horizontal extension mechanisms are interrelated in one modification allowing the two cages to be oriented in a common vertical plane orthogonal to chassis motion at all times.

OBJECTS OF THE INVENTION

Accordingly, it is a primary object of the present invention to provide a pruning system which may be driven from the top of a platform attached to the pruning vehicle, avoiding the need for a separate driver.

Another primary object of the present invention is to provide a pruning system which includes a vehicle having special wheels which provide a solid foundation and are less likely to become stuck in an orchard environment. In fact, the instant invention benefits from adverse terrain to promulgate vehicle stability.

Another further object of the present invention is to provide a pruning system having a vehicle with a low slung central portion for stability and a platform fastened to the low slung portion such that when the platform is extended horizontally away from sides of the vehicle the vehicle is less likely to roll over off of its wheels.

Another further object of the present invention is to provide a pruning system having a vehicle with an engine which causes the wheels of the vehicle to move and which drives hydraulic motors which cause platforms on the vehicle to move upwardly and downwardly and in and out (horizontally and perpendicularly) with respect to the direction of vehicle motion.

Another further object of the present invention is to provide a pruning system having a vehicle with platforms of a compact structure which still may extend significantly from the frame of the vehicle.

Another further object of the present invention is to provide a pruning system having separate platforms which may be independently moved by workers on the platforms.

Another further object of the present invention is to provide a pruning system which is easy to manufacture and easy to maintain.

Another further object of the present invention is to provide a pruning system which can efficiently and economically prune trees within an orchard.

Viewed from a first vantage point it is an object of the present invention to provide an orchard pruning vehicle comprised of a frame supporting the vehicle, wheels connected to the frame and supporting the frame above ground, an engine upon the frame imparting rotation to the wheels to move the vehicle along the ground, and a plurality of platforms supported above the frame by a movable connection means moving the platforms both vertically substantially perpendicularly to the vehicle's motion and horizontally substantially perpendicularly to the vehicle's motion.

Viewed from a second vantage point it is an object of the present invention to provide an orchard pruning vehicle for maintenance of trees in orchards having irregular terrain and variable ground conditions comprised of a frame supporting the vehicle, a plurality of wheels attached to the frame and supporting the frame above the ground, and a plurality of platforms supported above the frame by a moveable connection means locating the platforms distant from the frame of the vehicle; and wherein each wheel is of a substantially rigid disc shape comprised of a hub fastenable to an axle connected to the frame and to an engine providing power for rotation of the wheels, a circular rim forming a periphery of the wheel surrounding the hub and coaxial with the hub, and a disc having a greater thickness near a central opening and a lesser thickness near a peripheral edge, the disc fitting between the circular rim and the hub, the disc fixedly attached to the rim at the peripheral edge and fixedly attached to the hub at the central opening, the disc being of decreased thickness as the disc extends from the hub to the rim.

Viewed from a third vantage point it is an object of the present invention to provide a pruning system comprising a vehicle including a frame and attached wheels, an engine upon the frame powering the pruning system, and a multiple of two platforms oriented in pairs in planes substantially perpendicular to the direction to the vehicle's motion and adjustably locatable with respect to the frame.

Viewed from a fourth vantage point it is an object of the present invention to provide a machine for pruning trees comprised of a frame, wheels supporting the frame above ground, a plurality of platforms supported above the frame by a moveable connection means capable of locating the platforms distant from the frame and an engine which powers hydraulic motors interposed between the engine and the wheels which in turn impart rotation to the wheels, and wherein the moveable connection means of the platforms is a series of moveable interconnected rigid supports powered by a series of hydraulic rams in turn powered by the engine, and wherein steering of the wheels is accomplished by adjustment of hydraulic rams driven by output from the engine.

DESCRIPTION OF THE PREFERRED EMBODIMENT

Figure 1:
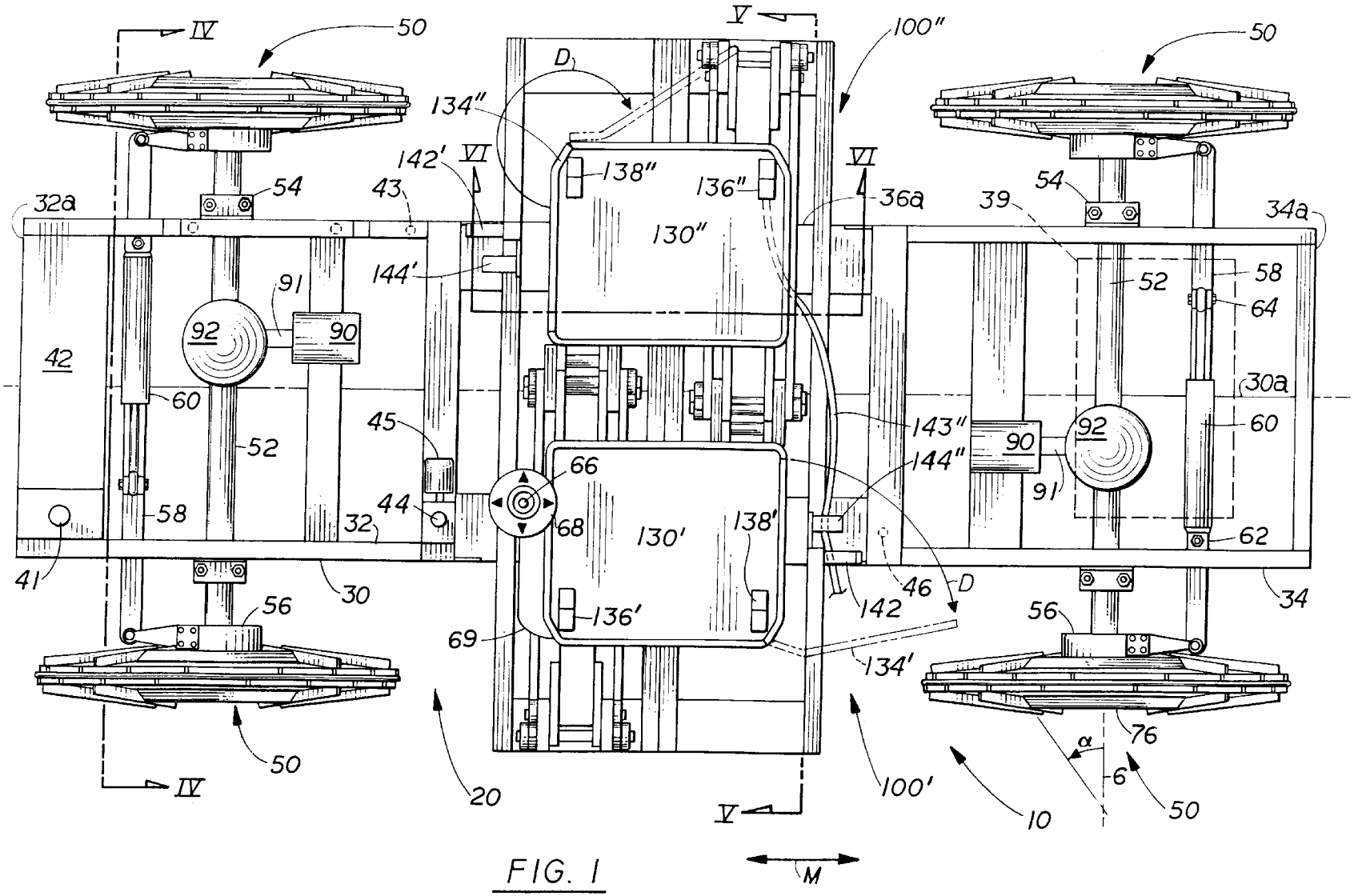
FIG. 1 is a plan view of the device of this invention.

Referring now to the drawings wherein like numerals represent like parts throughout, numeral 10 refers to a pruning vehicle. The vehicle is composed of a chassis 20 which is supported above ground by wheels 50 and has extending from the chassis 20 two scaffolds 100, one on each side of the chassis 20. The scaffolds 100 lift operators above the ground to reach trees for pruning.

In essence and referring to FIGS. 1 through 6, the chassis 20 is comprised of a rigid frame 30 having various major parts attached thereto. An engine 39 and engine housing 40 (FIG. 2) are affixed to the frame 30. A gas tank 42 is affixed to the frame 30. Two axles 52 are attached to the frame 30 which fasten to wheels 50.

The wheels 50 of the pruning vehicle 10 (shown, for example, in FIGS. 1 and 2) are each composed of a central hub 72 surrounded by a disc 82 which is in turn surrounded by a rim 78. The hub 72 is a circular construct attachable to the axle 52. The disc 82 is a construct of circular cross-section which fixedly attaches to the hub 72 and extends out to the rim 78. The rim 78 forms the outermost edge of the wheel 50. The rim 78 is fixedly attached to the disc 82.

Figure 3:
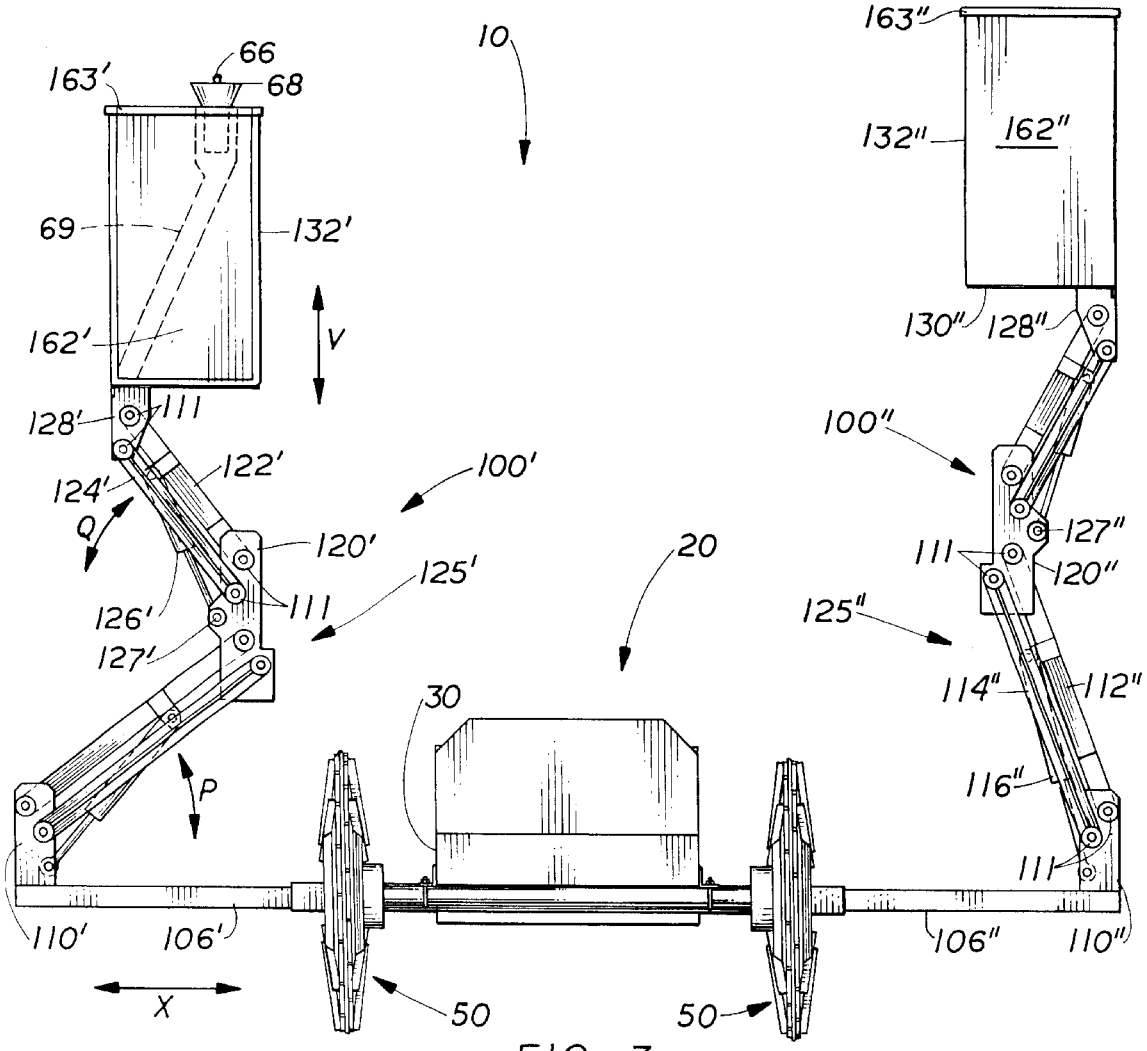
FIG. 3 is a front view of the device of this invention with portions of the device extended in different ways.

The scaffolds 100 of the pruning vehicle 10 are fixedly attached to the frame 30 on an upper side thereof as shown in FIG. 3, for example. Each scaffold 100 has a platform 130 with a cage 132 affixed thereon. The platform 130 is adjustable in relationship to the frame 30 both vertically and horizontally through a moveable connection means 125. Each operator on each platform 130 can independently control his/her scaffold 100 while on the platform 130. One of the operators can control the motion of the pruning vehicle 10 through the wheels 50 while upon one of the platforms 130. Preferably, the wheels 50 are controllable by an operator on the scaffold 100 to the left of the chassis 20.

More specifically, and referring to FIGS. 1 through 6, the chassis 20 is shown. The frame 30 of the chassis 20 is a rigid rectangular skeletal construct when viewed from above. The frame 30 is divided into a forward structure 32, a rearward structure 34 and a central structure 36. Each structure 32, 34, 36 is substantially square when viewed from above. The forward structure 32 has a leading edge 32*a*on one side thereof and is attached to the central structure 36 on an opposite side thereof through a forward transition structure 33. The forward transition structure 33 is fixedly attached to the rearward side of the forward structure 32 and forward side of the central structure 36. The forward transition structure 33 allows the central structure 36 to be positioned below the elevation of the forward structure 32.

The rearward structure 34 has a trailing edge 34*a*on one side thereof and is attached to the central structure 36 through a rearward transition structure 35. The rearward transition structure 35 is fixedly attached to a forward end of the rearward structure 34 and a rearward end of the central structure 36. Both transition structures 33, 35 are disposed in a vertical plane and are substantially rectangular. A long axis 30*a*of the frame 30 extends from the leading edge 32*a*to the trailing edge 34*a*and defines a longest dimension of the frame 30. The central structure 36 is located within a mid-section 36*a*intermediate between the leading edge 32*a*and the trailing edge 34*a*and is positioned below the rearward structure 34 by being attached to an opposite (lower) end of the rearward transition structure 35 as is the rearward structure 34. In this way, the central structure 36 is positioned at an elevation below the rearward structure 34. The forward structure 32 and rearward structure 34 are substantially in the same elevation. Gussets G may reinforce the connection of the transition structures 33, 35 to the forward, central and rearward structures 32, 34, 36.

Figure 5:
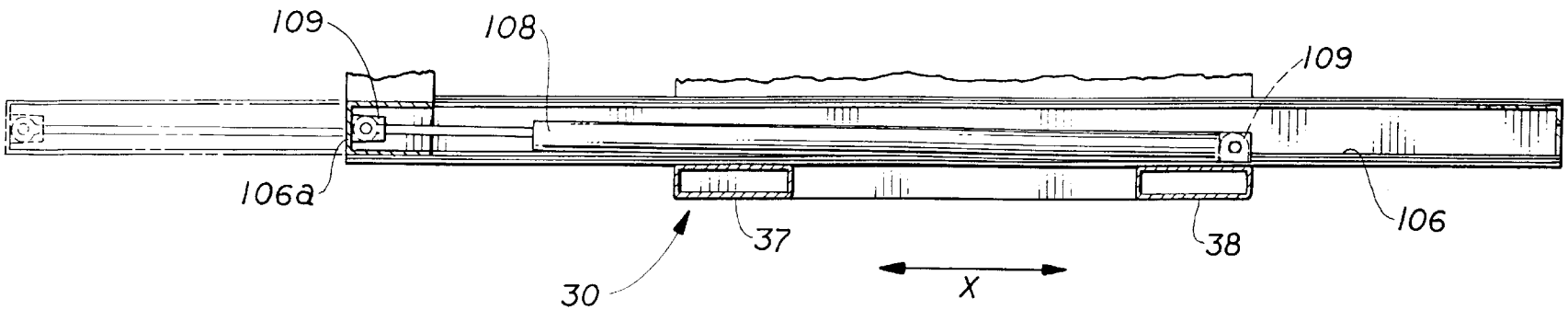
FIG. 5 is a cut away sectional view of a portion of the device of this invention as shown in FIG. 1 taken along lines 5—5.

The central structure 36 may be subdivided into a left box beam 37 and a right box beam 38 as shown in FIG. 5. The central structure 36 is thinner when viewed from the side than the forward structure 32 or the rearward structure 34. The relative thinness and lower elevation of the central structure 36 allows the pruning vehicle 10 to be more stable by providing a lower center of gravity. This is especially important when the scaffolds 100 are extended, and yet the device still has substantial ground clearance.

The engine 39 and engine housing 40 are located on an upper surface of the rearward structure 34 of the frame 30. The engine 39 may be one of any type of engine which can activate hydraulic motors and hydraulic rams.

A gas tank 42 is mounted on the frame 30 on the forward structure 32 thereof. A gas filler opening 41 is located near the gas tank 42 on the forward structure 32. Gas lines (not shown) run within the members making up the frame 30 and then extend out to the engine 39 through a gas line connection 43.

An oil filler 44 and oil filter 45 are also mounted on the forward structure 32 of the frame 30 and are connected to an oil line which extends to the engine 39 through an oil line connection 46 near the engine 39 on the rearward structure 34 of the frame 30. The oil line and gas line associated with the connections 43, 46 have been removed from FIG. 1 to add further clarity to FIG. 1. These lines extend from their connections 43, 46 to the engine 39 following one of a variety of possible routes, the choice of which is not critical to performance of the vehicle 10.

Axles 52 are mounted beneath both the forward structure 32 and the rearward structure 34 of the frame 30. Each axle 52 is of similar design. The axles 52 are connected to the frame 30 through axle mounts 54. One axle mount 54 is located on each side of the frame 30 for each axle 52.

A hydraulic motor 90 is mounted on both the forward structure 32 and the rearward structure 34. The hydraulic motors 90 are of similar construction. Each hydraulic motor 90 receives power from the engine 39. Each hydraulic motor 90 has an output shaft 91 which is rotated by the hydraulic motor 90. The output shaft 91 of each hydraulic motor 90 extends into a differential 92 mounted on each of the axles 52. Each differential 92 is interposed with each axle 52 so that hydraulic motors 90 may drive wheels 50 attached to each end of each axle 52.

Figure 4:
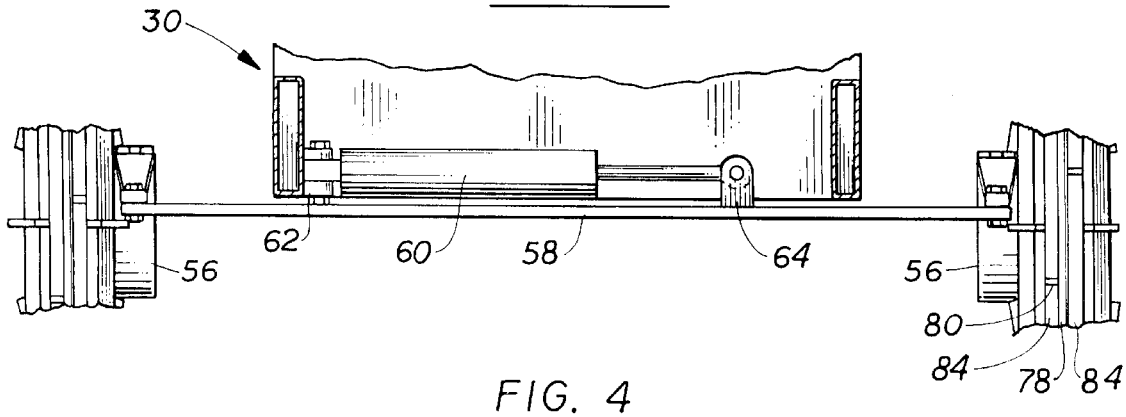
FIG. 4 is a cut away sectional view of that which is shown in FIG. 1 taken along lines 4—4 with portions removed to reveal additional details.

At each junction of a wheel 50 and an axle end 52 is located a universal (constant velocity) joint (not shown) and a steering collar 56 (see FIG. 4). The steering collar 56 is connected to the wheel 50 in a manner such that when the steering collar 56 is pivoted the wheel 50 also pivots. However, the steering collar 56 preferably does not rotate along with the wheels 50. The steering collars 56 are attached to two wheels 50 which are attached to the same axle 52 and are connected together by a steering tie rod 58. This connection is similar to that of many four-wheel drive or front wheel drive automobiles.

The constant velocity joint (not shown) connects the axle 52 to the hub 72 of the wheel 50. Each of the two tie rods 58 are suspended beneath the frame 30 and are pivotably connected through a tie rod mount 64 to one end of a steering ram 60. The other end of the steering ram 60 is pivotably attached through a frame mount 62 to the frame 30. When the steering ram 60 is extended or contracted the tie rod 58 is moved to the left or to the right causing wheels 50 to be turned.

Each wheel 50 on the pruning vehicle 10 is of substantially the same construction. A hub 72 forms a center of the wheel 50. The hub 72 has means for fastening to the end of the axle 52 and which allow the wheel 50 to be driven by the differential 92. The hub 72 has a cylindrical shape with its central axis colinear with a central axis of the axle 52. A disc 82 is fixedly attached to the hub 72 at its perimeter, extending radially outwardly therefrom. A rim 78 is located at a peripheral edge 84 of the disc 82. The rim 78 is a toroidal rigid construct and is fixedly attached to the disc 82. The disc 82 is itself a circular cross-sectioned rigid construct having a central opening 83 fixedly attached to the hub 72. The hub 72 has a greater width (thickness) than the rim 78. The disc 82 is of greater width (i.e. thickness) adjacent to the hub 72 than its width adjacent to the rim 78. Thus, the disc 82 decreases in thickness and tapers from the hub 72 to the rim 78. In cross-section, the disc 82 appears to have a truncated wedge shape such as that of a truncated isosceles triangle.

A plurality of fins 74 extend radially from the hub 72 to the rim 78 and are fixedly attached to the disc 82 on both inner and outer surfaces thereof. Each fin 74 is a rigid linear construct. The fins 74 provide both additional support to the wheel 50 and also help the wheel 50 pass through soft substances with less slippage.

A plurality of side rim teeth 80 are fixedly attached to inner and outer sides of the rim 78. Each tooth 80 extends from a position adjacent to the rim 78 to a position at the edge of the disc 82 such that the tooth 80 does not extend beyond the disc 82. The teeth 80 are all fixedly attached to the perimeter of the disc 82. The teeth 80 provide additional traction to the wheels 50 by acting as cleats.

A plurality of mud deflectors 76 are fixedly attached to the discs 82 on inner and outer surfaces thereof. The deflectors 76 can be formed from angle iron. Each mud deflector 76 extends axially outwardly from the surface of the disc 82 at an angle a which slopes toward an axis of symmetry 6 of the wheel 50. The deflectors 76 extend like chords on a circle between fins 74. As mud collects on the disc 82 and rises up sides of the wheel 50 towards the hub 72 with progressive rolling of the wheel 50, the mud deflectors 76 force the mud outwardly away from the wheels 50, causing the mud to fall back to the ground. Thus the wheels 50 are somewhat self-cleaning. In this way, mud is prevented from interfering with the rotation of the wheels 50 and with the connection between the wheels 50 and ends of the axles, 52 by tending to limit the degree to which the device 10 can sink into a muddy field. The deflectors 76 coupled with the wedge-shaped taper of the disc 82 control sinking of the device 10 into mud.

In use and operation, the wheels 50 provide a solid foundation for the pruning vehicle 10, even on soft surfaces. The rim 78 is thin enough to penetrate into the ground until a solid surface is impacted. The wheels 50 are thin enough to slice through soft material when rotation is imparted by the hydraulic motors 90. This "controlled penetration" into soft earth gives greater stability to the vehicle 10, especially during inclement weather.

Figure 2:
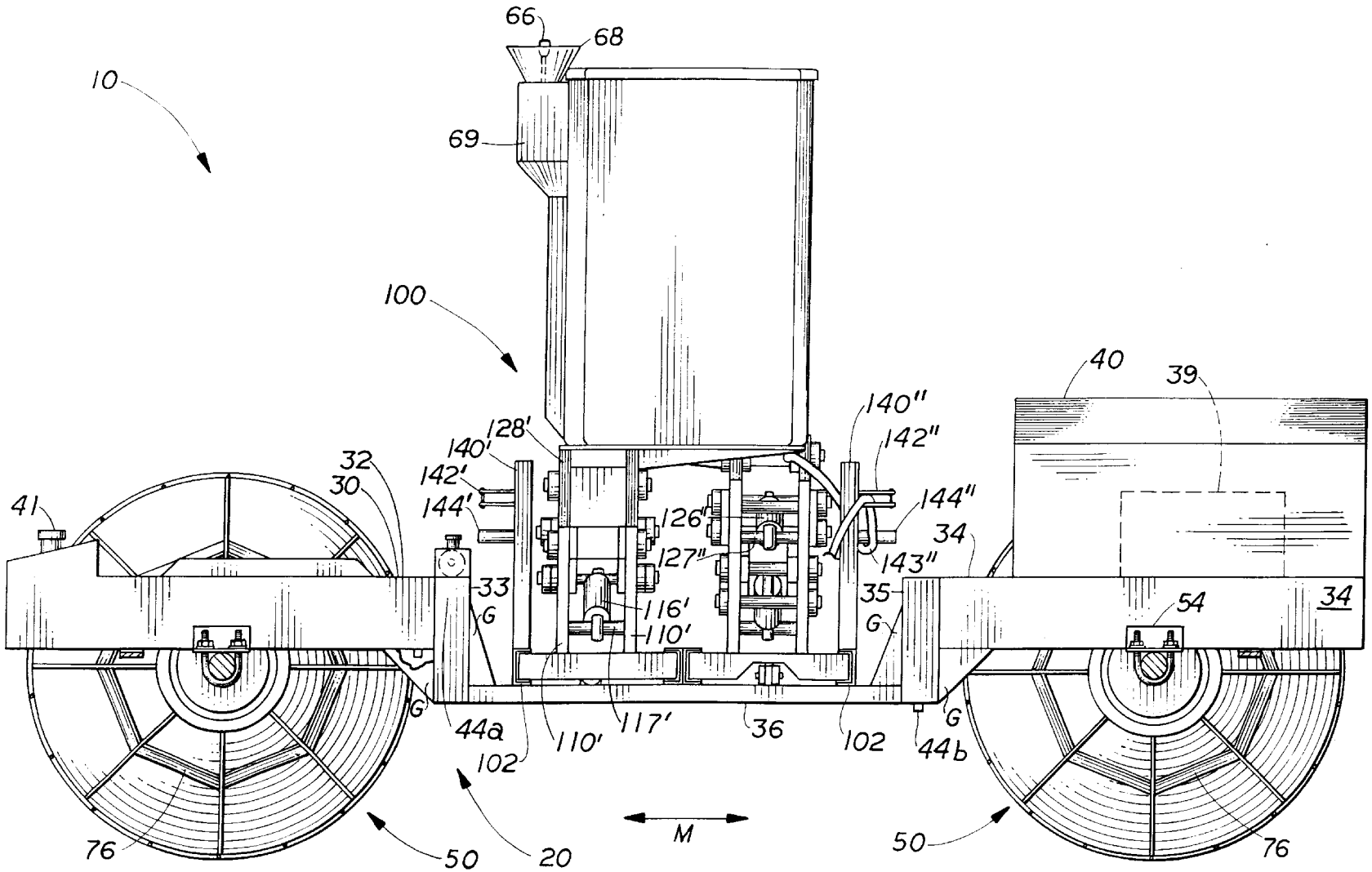
FIG. 2 is a right side view of the device of this invention with portions cut away to reveal hid details.

Referring now to FIGS. 1 through 6 details of the scaffolds 100 are shown. Each scaffold 100 of the pruning vehicle 10 connects to the chassis 20 through the central structure 36 of the frame 30. In FIGS. 2 and 5, two guides 102 are fixedly attached on an upper surface of the central structure 36. One guide 102 is on a forward side thereof and supports the left scaffold 100. The other guide 102 is on a rearward side thereof and supports the right scaffold 100. Each guide 102 is a rigid member of substantially "C"-shaped cross-section which extends perpendicular to the direction of vehicle 10 motion "M" (see FIG. 2). The guides 102 are horizontally disposed across opposite sides of the frame 30. A central guide 104 is located parallel and between the two guides 102 at a location near the center of the central structure 36. The central guide 104 has two open sides of "C"-shaped cross-section facing forward and rearward while the guides 102 have open portions of their "C"-shaped cross-sections facing toward the central guide 104. Thus, the guides 102, 104 open portions face each other to support two slides 106.

The slides 106 are oriented between the guides 102 and the central guide 104. The slides 106 are of a thickness equal to the interior height of the "C"-shaped cross-sections of the guides 102, 104. The slide 106 is of substantially the same length as is the width of the frame 30.

Having this shape, the slides 106 fit between the guides 102, 104 and are securely restricted from both vertical motion and horizontal motion in the direction of vehicle 10 motion M. The slides 106 are allowed to slide freely horizontally, perpendicular to the direction of vehicle 10 motion, along arrow X of FIG. 3.

Figure 6:
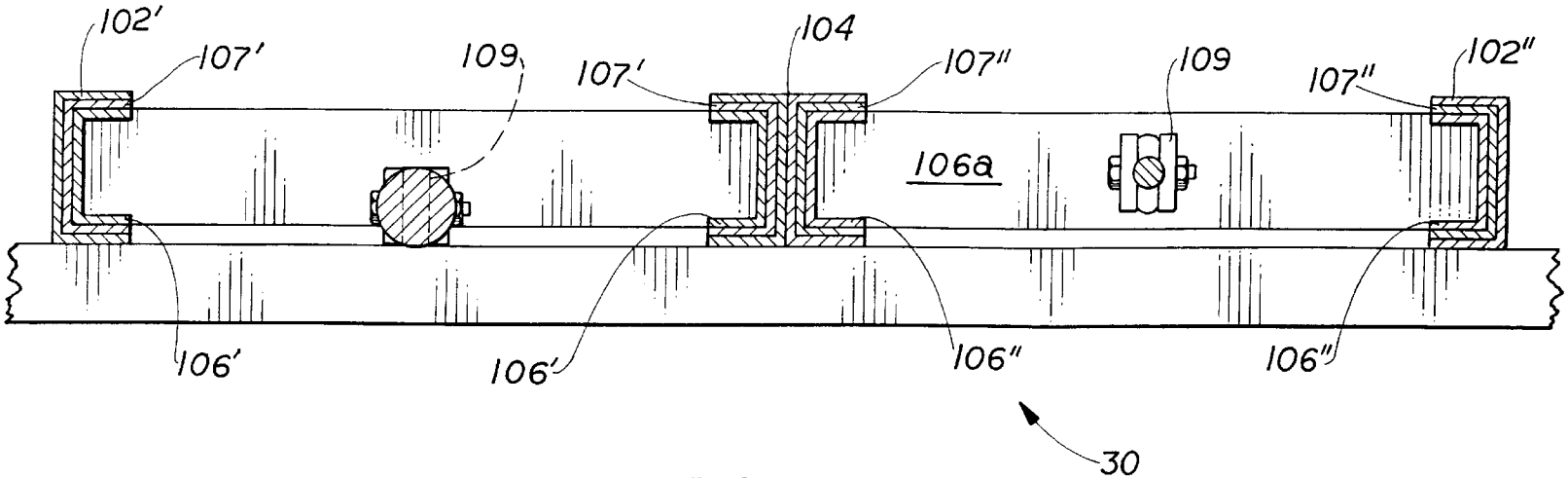
FIG. 6 is a cut away sectional view of a portion of the device of this invention as shown in FIG. 1 taken along lines 6—6.

With reference again to FIG. 5, slide rams 108 are interposed between the box beams 37, 38 of the central structure 36 and outside ends 106*a* of the slides 106. The rams 108 attach to the slides 106 and central structure 36 through attachment brackets 109. The attachment brackets 109 allow each ram 108 to pivot somewhat but restricts ends of the ram 108 from translation. When the ram 108 is extended, the associated slide 106 slides through the guides 102, 104 and is extended horizontally perpendicular to the direction of vehicle 10 motion M. When the ram 108 is contracted, the slide 106 is returned to its position closer to the frame 30. FIG. 5 shows the action of the rams 108 in detail and FIG. 6 shows the connection of the rams 108 and attachment brackets 109 in detail.

Lubrication layers 107 are shown interposed between the guides 102, 104 and the slides 106. The layers 107 assists the slides 106 allowing them to slide more freely. An example of layers 107 may include grease, smooth solid layers of low friction hydro carbon substances or the like.

Bases 110 are shown in FIGS. 2 and 3 fixedly attached to upper surfaces of each of the slides 106 near outside ends 106*a*of the slides 106. The bases 110 are rigid and upwardly extending. Pivotably attached to tops of each base 110 is a lower driver 112. The driver 112 is a rigid elongate structure. One driver 112 is attached to each base 110 at the driver's lower end through a pivot pin assembly 111. Each assembly 111 includes a pivot pin fastened within holes formed in each base 110. The pivot pin of the assembly 111 extends in a direction substantially parallel to the direction of the vehicle 10 motion M. The assembly 111 allows each driver 112 to pivot freely with respect to its attached base 110 (about arrow P shown in FIG. 3) while restricting the driver 112 from being displaced linearly from its base 110.

A lower follower 114 is pivotably attached to a central portion of each base 110. The follower 114 is substantially similar in characteristics to the driver 112. One follower 114 is connected to each base 110 through another assembly 111. Thus, each follower 114 is free to rotate with respect to its attached base 110 (about arrow P), but is not allowed to move linearly with respect to its base 110.

The drivers 112 are pivotably attached at upper ends opposite the bases 110 to left intermediate risers 120. The upper ends of the drivers 112 attach to the risers 120 at a location just below a midway point between a top and a bottom of each of the risers 120. Assemblies 111 attach the drivers 112 to the risers 120. Thus, the risers 120 and drivers 112 are rotatable with respect to each other but not translatable.

The followers 114 are pivotably attached on upper ends to lower portions of the risers 120. Assemblies 111 are utilized to attach the followers 114 and the risers 120 together. Thus, the followers 114 and risers 120 are free to rotate about each other but are restricted from relative translation. Each driver 112 and each follower 114 is attached to the bases 110 and risers 120 in a manner such that each driver 112 is substantially parallel to its adjacent follower 114. The drivers 112 and followers 114 are substantially the same length. Thus, four bar linkages defining parallel motion mechanisms are provided with links 112, 114 and captured portions of bases 110 and risers 120 therebetween.

Because of the geometric symmetry of the drivers 112 and followers 114 and the orientation of the drivers 112 and followers 114 on the bases 110 and the risers 120, the risers 120 are restricted so that they may only move in a specific confined pattern. This pattern of riser 120 motion prohibits the risers 120 from pivoting with respect to the bases 110. Thus, the risers 120 can only move vertically and horizontally perpendicular to the direction of vehicle 10 travel and may not rotate with respect to the bases 110.

A lower hydraulic ram 116 is pivotably connected to a lower portion of each base 110 and a central portion of each driver 112. Attachment brackets 117 are utilized to connect ends of each ram 116. Thus, when one of the rams 116 is extended, the driver 112 pivots about the base 110 (arrow P) causing the riser 120 to move upwards. The follower 114 is also caused to pivot due to its attachments to the riser 120 and base 110. The follower 114 restricts the riser 120 from pivoting with respect to the base 110.

An upper driver 122 is pivotably attached to an upper end of each riser 120. Each driver 122 is a rigid elongate structure similar in characteristics to the driver 112 but where driver 112 points in toward the center of the device 10, driver 122 points outwardly. The drivers 122 are connected at lower ends to the upper end of each riser 120 by pivot pin assemblies 111. The assemblies 111 allow each driver 122 to pivot freely about the adjacent riser 120 (about arrow Q) while restricting the driver 122 from translating with respect to the riser 120. An upper end of each driver 122 is pivotably attached to an upper riser 128. Each riser 128 is a rigid structure. The drivers 122 utilize pivot pin assemblies 111 to pivotably attach to the risers 128.

A left upper follower 124 is pivotably attached on a lower end to each riser 120 at a point just above the midpoint of the height of each riser 120. The followers 124 utilize pivot pin assemblies 111 to pivotably connect to the risers 120. The followers 124 are substantially similar in characteristics to the followers 114. The assemblies 111 allow the followers 124 to pivot with respect to the risers 120 while restricting the followers 124 from translating with respect to the risers 120.

An upper end of each follower 124 is pivotably attached to a lower end of the adjacent riser 128. The followers 124 are pivotably attached to the risers 128 through pivot pin assemblies 111. In this way, the followers 124 are allowed to pivot freely about the risers 128 while being restricted from linear translation. Thus, a second set of four bar linkages defining a parallel motion mechanism are provided.

The drivers 122 and followers 124 are connected to each riser 120 and riser 128 in a configuration causing them to remain parallel to each other at all times. This geometric configuration causes each riser 128 to remain oriented to the adjacent riser 120 in a non-rotating relationship. Because the risers 128 does not rotate with respect to the risers 120 and the risers 120 do not rotate with respect to the bases 110, the risers 128 do not rotate with respect to the bases 110.

Upper hydraulic rams 126 are interposed between the risers 120 and the drivers 122. Ends of each ram 126 are connected to a central portion of each driver 122 through attachment brackets 127. The lower ends of each ram 126 are pivotably attached to mid-portions of the risers 120 through attachment brackets 127.

Thus, when one of the rams 126 is extended, the associated driver 122 pivots with respect to the adjacent riser 120, about arrow Q, causing the riser 128 to be moved vertically upwards. The follower 124 is also caused to move and restricts the riser 128 causing the riser 128 to remain oriented with respect to the riser 120 without rotation.

A platform 130 is fixedly attached to an upper surface of each riser 128. The platforms 130 are a thin substantially square rigid constructs. The platforms 130 are sized to comfortably support a person thereupon. A safety cage 132 extends above and circumscribes each platform 130. Each cage 132 has side walls 162 with an upper edge 163. The upper edge 163 of each cage 132 is at a height near the waist of an operator standing upon the platform 130.

One side of each cage 132 forms a door 134, shown in FIG. 1. The doors 134 provide operators with access into and out of the cages 132. When the doors 134 are opened, the rams 108, 116, 126 are preferably disabled thereby preventing the associated scaffold 100 from moving and providing enhanced safety.

In/out pedals 136 are located on top surfaces of the platform 130 on a side thereof which corresponds to an operator's right foot when the operator faces away from the vehicle 10. The in/out pedals 136 have three positions: a neutral position, an "in" position and an "out" position. When in the neutral position, the associated scaffold 100 does not move horizontally along arrow X. When the "in" portion of the in/out pedal 136 of one of the scaffolds 100 is depressed, the ram 108 of that scaffold 100 is contracted causing the slide 106 and the scaffold 100 to move toward the vehicle 10 along arrow "X". When the "out" portion of the in/out pedal 136 of one of the scaffolds 100 is depressed the ram 108 is caused to extend. This causes the slide 106 to move outwardly away from the pruning vehicle 10. Utilizing the in/out pedals 136, operators on the platforms 130 may easily move the scaffolds 100 in and out, toward and away from the pruning vehicle 10.

Up/down pedals 138 are located on a top surface of each platform 130 on a side thereof which corresponds to a left foot of an operator facing away from the vehicle 10. The up/down pedals 138 have three positions: A "down" position, an "up" position and a neutral position. When in the neutral position, the associated scaffold 100 remains fixed vertically. When the "down" portion of one of the up/down pedals 138 is depressed, the ram 116 and ram 126 of the scaffold 100 are caused to contract. This causes the scaffold 100 to be lowered (along arrow "V") from a higher position to a lower position with respect to the chassis 20. When the "up" portion of one of the up/down pedals 138 is depressed, the ram 116 and ram 126 of the scaffold 100 are extended, causing the scaffold 100 to extend vertically (along arrow "V") causing the platform 130 to move from a lower position to a higher position with respect to the chassis 20.

A cable support stand 140 is fixedly attached adjacent to each box beam 37, 38 on a side thereof, shown in FIGS. 1, 2, 7 and 8. The stands 140 are rigid elongate constructs which extend vertically upward and support cables connected to the scaffolds 100 through a clamp 142 and a roller 144 fixedly attached thereto.

Cables 143 representative of the numerous electric and hydraulic cables connecting various controls 138, 136 are shown routed through one of the support stands 140. The remaining cables, such as those activating the rams 108, 116, 126 are not shown to more clearly show other elements of the chassis 20.

Figure 8:
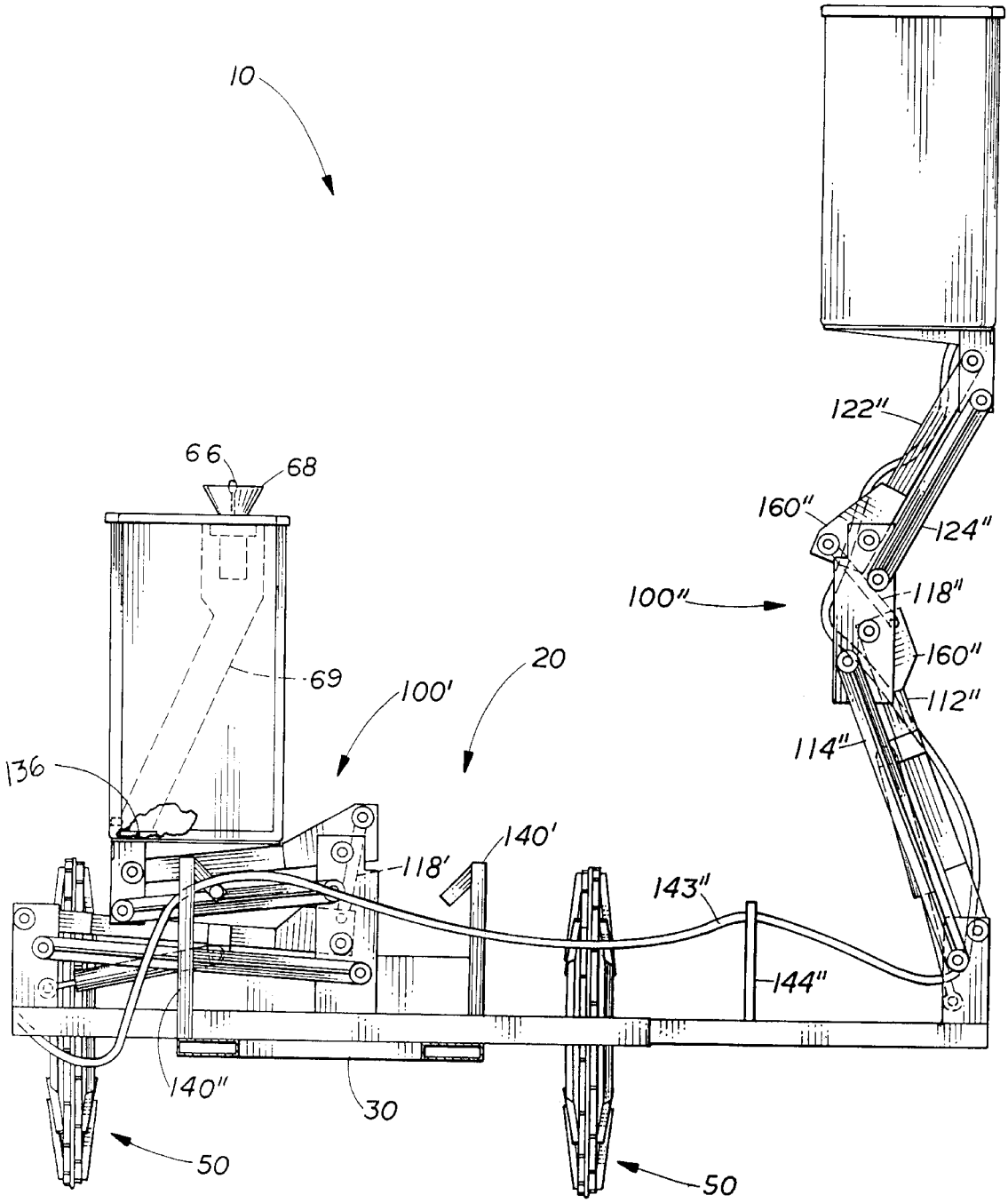
FIG. 8 is a sectional view of that which is shown in FIG. 7 taken along lines 8—8.
Figure 9:
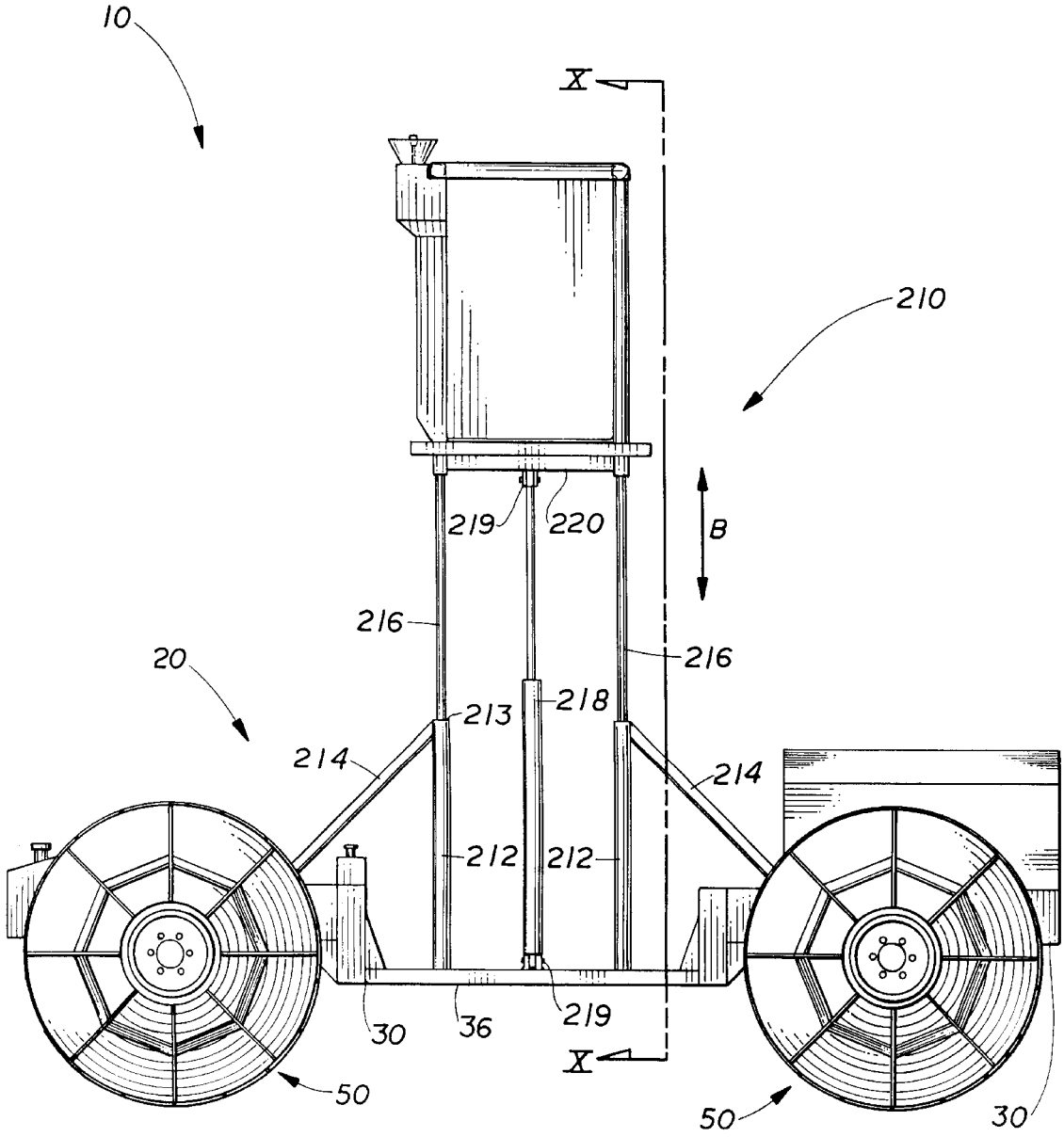
FIG. 9 is a front view of another alternative embodiment of this invention.
Figure 10:
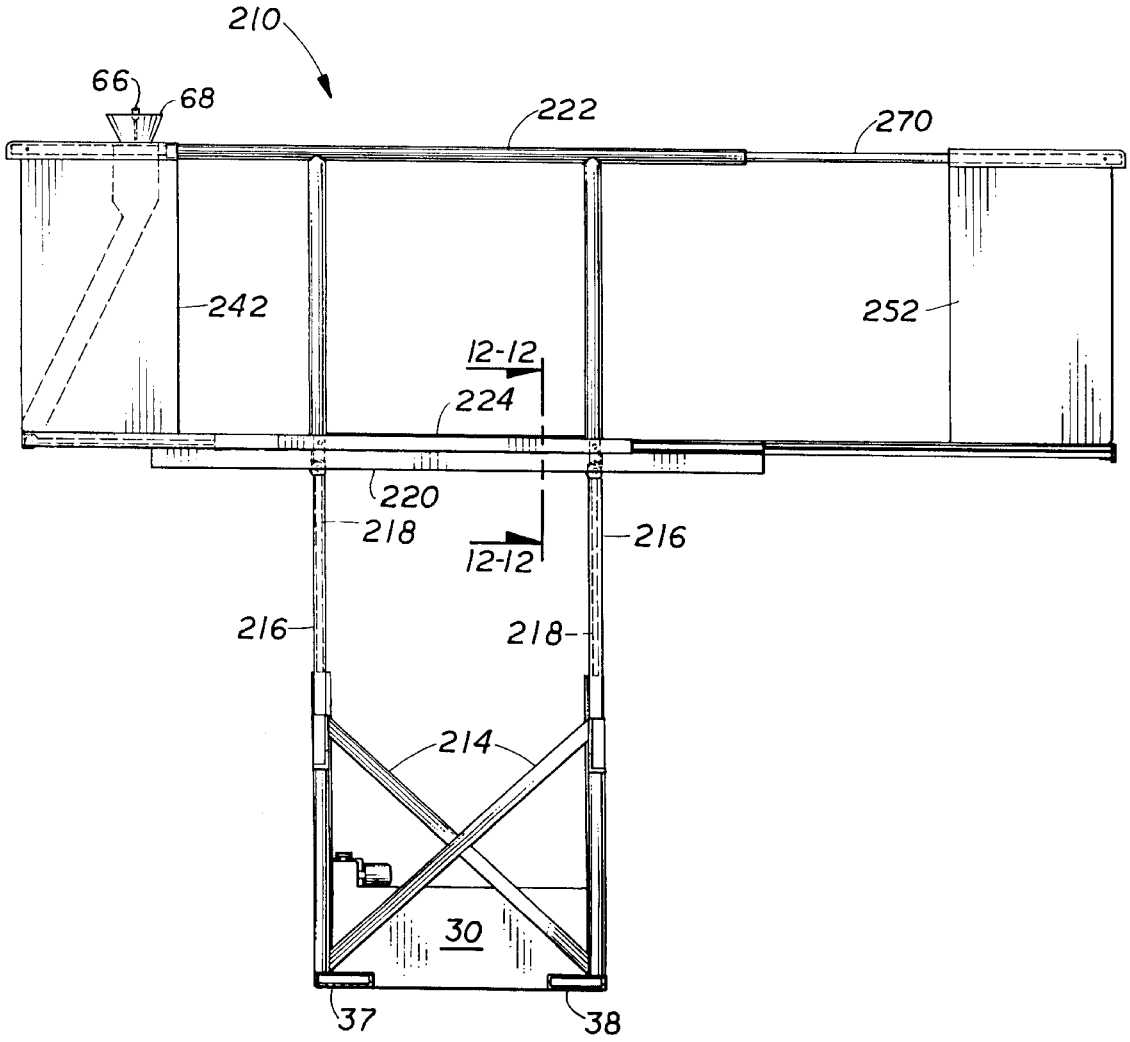
FIG. 10 is a cross-section of that which is shown on FIG. 9 taken along lines 10—10.

A steering joystick 66, shown in FIG. 8, is located on a forward side of an upper edge 163 of one of the cages 132. Preferably, the cage 137 of the left scaffold 100 supports the joystick 66. A frame 68 surrounds the joystick 66. A steering apparatus cover 69 extends down a side of the cage 132. The cover 69 contains wiring and hydraulic lines necessary to operatively connect the joystick 66 to the wheels 50 and engine 39 of the vehicle 10.

The joystick 66 is free to move in all horizontal directions including forward, reverse, left and right. When the joystick 66 is placed in a neutral position the pruning vehicle 10 remains fixed in place. When the joystick 66 is moved forward the hydraulic motors 90 are activated causing the wheels 50 to turn forward causing the pruning vehicle 10 to move forward. When the joystick 66 is moved to the reverse position the hydraulic motors 90 are activated causing the wheels 50 to turn causing the vehicle 10 to move in reverse.

When the joystick 66 is moved to the left the forward steering ram 60 (FIG. 1) is extended causing the forward wheels 50 to turn positioning the vehicle 10 to make a left turn. The rearward wheels 50 may also turn through simultaneous contraction of the rearward steering ram 60. When the joystick 66 is moved to the right the forward steering ram 60 is compressed and the rearward steering ram 60 is extended causing the wheels 50 to position themselves for the vehicle 10 to turn to the right. When the joystick 66 is positioned in intermediate positions between the above-described positions a combination of forward or rearward motion is combined with pivoting of the wheels 50 causing the vehicle 10 to move and turn simultaneously.

In use and operation, the pruning vehicle 10 is used in the following manner. First the engine 39 of the pruning vehicle 10 is started activating all of the hydraulic systems on the pruning vehicle 10. Two operators position themselves one on each platform 130. The operator on the left platform 130 then operates the joystick 66 to position the vehicle 10 within a row in an orchard to be pruned. Once the vehicle 10 is positioned between two trees on the orchard row, the vehicle 10 is brought to a stop. Each operator then separately operates the in/out pedals 136 and up/down pedals 138 to position the scaffolds 100 wherever the operators desire them to be located for ease of pruning. When each operator has completed pruning at the vehicle 10 position, the left operator then operates the joystick 66 to move the vehicle 10 forward. This process is continued down the row of trees in the orchard.

Figure 7:
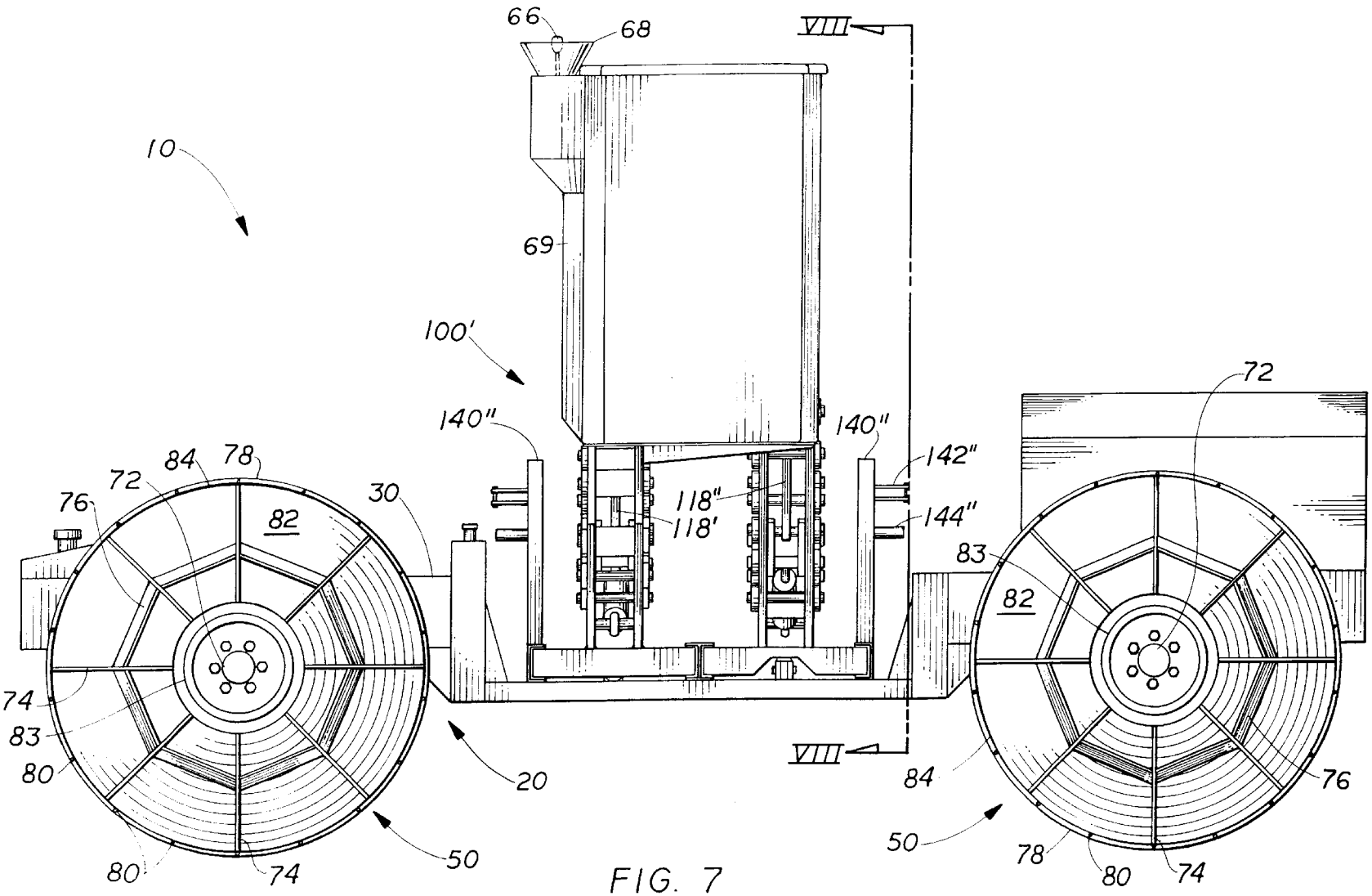
FIG. 7 is a front view of an alternative embodiment of this invention.

An alternative embodiment for the scaffolds of the pruning vehicle 10 is shown in FIGS. 7 and 8. The rams 126 are replaced with mechanical links 118. The mechanical links 118 are pivotably attached between upper ends of each driver 112 and lower ends of each driver 122 through assemblies 111 on both of the scaffolds 100. The mechanical links 118 cause the drivers 122 and followers 124 to be pivoted upwards at the same time that the drivers 112 and followers 114 are pivoted. This alternative embodiment avoids the requirement of the rams 126. However, this embodiment restricts the ability of each scaffold 100 to be elevated to the action of only ram 116 at any one time.

Referring now to FIGS. 9, 10, 11 and 12, another alternative embodiment of the invention is shown. The separate scaffolds 100 of the preferred embodiment are replaced with a central scaffold 210. The central scaffold attaches to the central structure 36 of the frame 30 through four base sleeves 212. Each sleeve 212 is an elongate rigid cylindrical hollow construct fixedly attached vertically to the central structure 36 of the frame 30. Each sleeve 212 has a sleeve support 214 extending from the sleeve's upper end diagonally to the rearward or forward structure 32, 34. Each support 214 is a rigid elongate structure fixedly attached in place.

Four base slides 216 are sized to fit within top openings of each sleeve 212. Upper ends of each slide 216 are fixedly attached to a scaffold frame 220. A base ram 218 is attached on a first end to the central structure 36 through a base attachment bracket 219 and attached through an attachment bracket 219 to the scaffold frame 220. When the ram 218 is extended, it causes the scaffold frame 220 to move vertically upward along arrow B also causing the slides 216 to move upwards within the sleeves 212.

Figure 11:
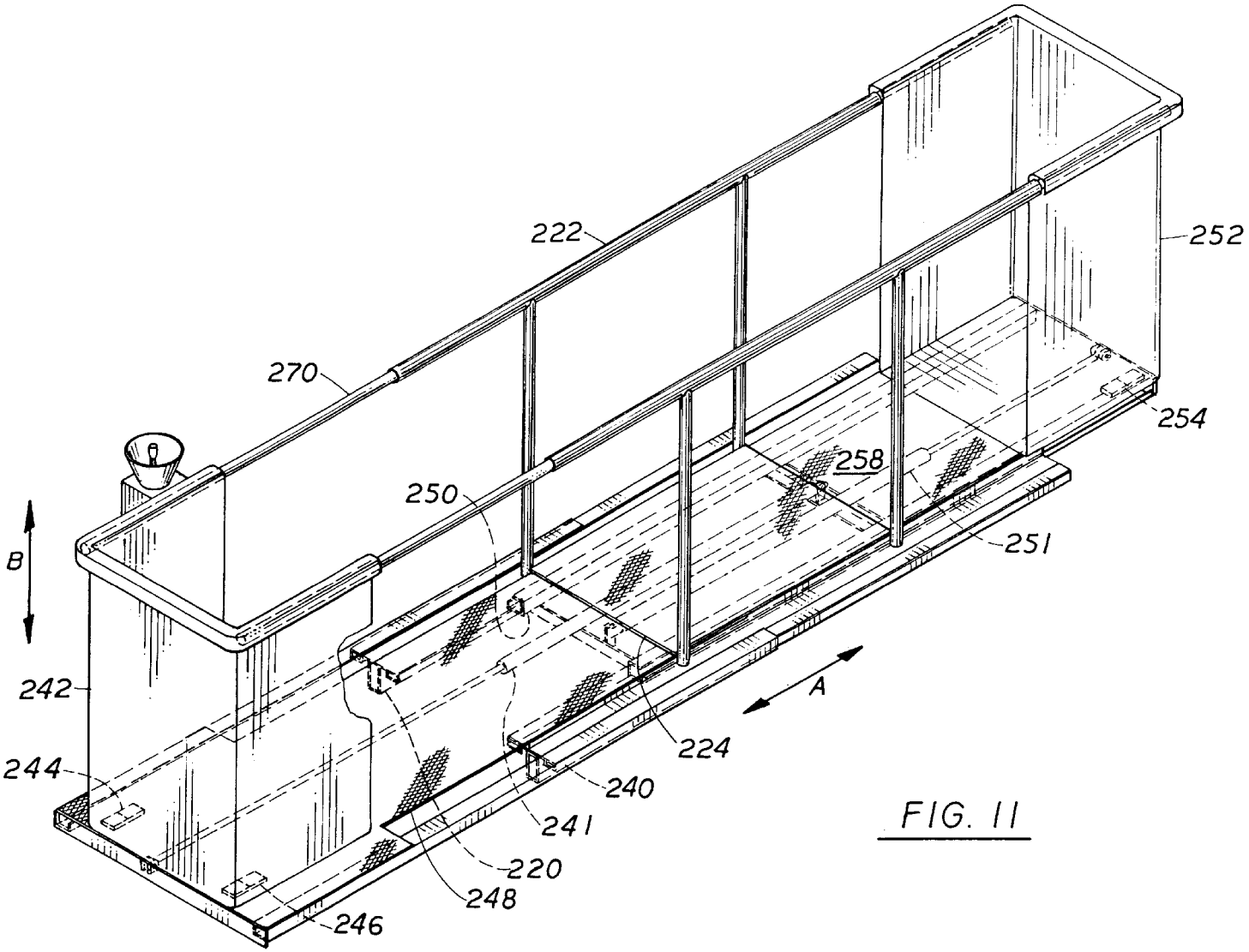
FIG. 11 is an isometric view of a portion of that which is shown in FIG. 9.

FIG. 11 shows the operators cage area. It is a single runway allowing one operator to access both sides. It has a scaffold frame 220 and two outer cages 242, 252 which telescope towards and away from the scaffold frame 220.

Figure 12:
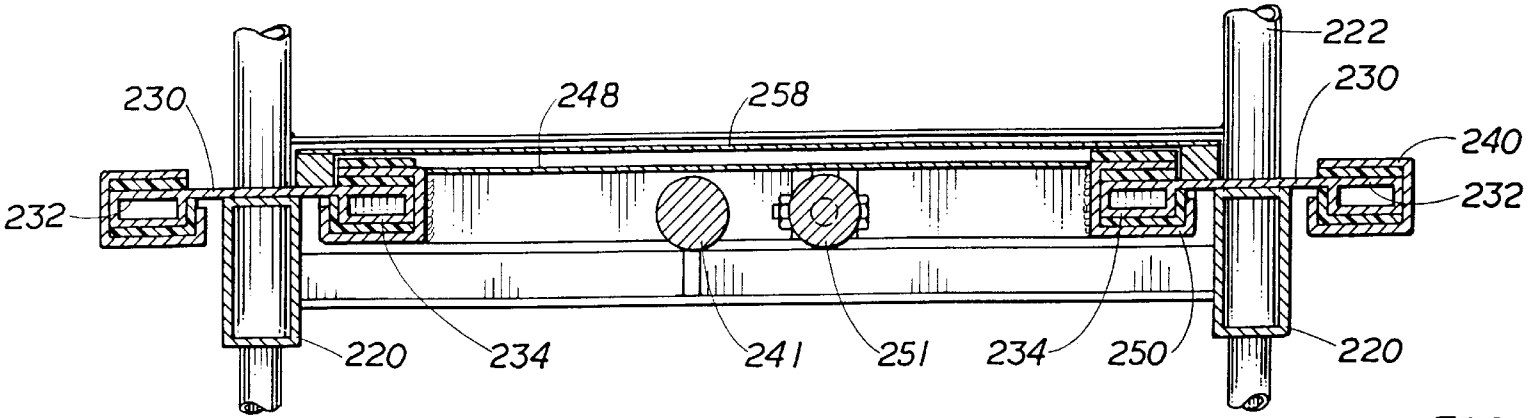
FIG. 12 is a cut away sectional view of that which is shown in FIG. 10 taken along lines 12—12.

The scaffold frame 220 has two lower supports 230 each with an inner right guide 234 and an outer left guide 232. The two outer guides 232 allow the left cage 242 to telescope while the inner guides 234 allow the right cage 252 to telescope. Details of the scaffold frame 220 are shown in FIG. 12.

Each of the guide portions 232, 234 is an elongate construct of rectangular cross-section. The scaffold guides 230 are rigid constructs forming a rail. The left guide portions 232 and right guide portions 234 form separate rails for horizontal positioning of a left cage 242 and a right cage 252.

Two left slides 240 are conformed to fit over the left guide portions 232 (FIG. 11). The left slides 240 slide horizontally along arrow "A". Two right slides 250 conform to the right guide portions 234 in a manner similar to the left guide portions 232. The right slides 250 allow the right cage 252 to slide horizontally along arrow "A".

The left slide 240 has the left cage 242 fixedly attached to its upper surface. A planar walkway 248 is fixedly attached to an upper surface of the left slide 240 between the cage 242 and the left slide 240. The cage 242 is similar in construction to the cage 132 of the preferred embodiment. The right slide 250 has the right cage 252 fixedly attached to its upper surface. A walkway 258 is fixedly attached to an upper surface of the right slide 250 between the cage 252 and the right slide 250. The cage 252 is similar in construction to the cage 182 of the preferred embodiment.

A handrail 222 (FIG. 10) is fixedly attached to the scaffold frame 220. The handrail 222 extends an appropriate distance above the scaffold frame 220 such that an operator standing on a fixed walkway 224 attached to the scaffold frame 220 will be able to grasp the handrail 222. Handrail extensions 240 are attached on one end to one of the cages 242, 252 and on an opposite end telescope within the handrail 222.

A left hydraulic ram 241 is pivotably attached between the scaffold frame 220 and the left slide 240. The ram 241 can be expanded causing the left slide 240 to extend allowing the cage 242 and associated walkway 248 to provide access for an operator to a location more distant from the vehicle 10. A ram 251 is pivotably attached between the scaffold frame 220 and the right slide 250 causing the right slide 250 and associated right walkway 258, handrail extension 255, and cage 252 to be extended outwardly horizontally in a direction opposite that of the left slide 240.

An up/down pedal 246 is positioned on the top surface of the left walkway 248. The up/down pedal 246 has three positions: a neutral position, an "up" position and a "down" position. The up/down pedal 246 is preferably located on a rearward side of the walkway 248 within the cage 242. When the up/down pedal 246 is in the neutral position the scaffold frame 220 remains at a constant height above the vehicle 10. When the "up" portion of the up/down pedal 246 is depressed the scaffold frame 220 is caused to increase in elevation along arrow B by extension of the ram 218. When the "down" portion of the up/down pedal 246 is depressed the ram 218 is compressed causing the scaffold frame 220 to be lowered with respect to the vehicle 10.

An in/out pedal 244 is located on an upper surface of the walkway 246 on the forward side thereof. The in/out pedal 244 has three positions which correspond to the three positions of the in/out pedal 136 of the preferred embodiment. The in/out pedal 244 may be utilized by the operator to move the left slide 240 in and out causing the cage 242 to extend horizontally along arrow A.

An in/out pedal 254 is located on an upper surface of the walkway 258 on a rearward side thereof and at end thereof distant from the scaffold frame 220. The in/out pedal 254 has three positions which correspond to the three positions of the in/out pedal 186 of the preferred embodiment. Utilizing the in/out pedal 254, the operator is able to move the right slide 250 and associated walkway 258, hand rail extensions 245, and cage 252 outward horizontally along arrow A.

When this embodiment is utilized, access is provided at all times between the left cage 242 and the right cage 252. This allows a single operator to prune two adjacent trees without moving the vehicle 10 or climbing out of either cage 242, 252. The joystick 66 is located on the central scaffold 210 preferably at the cage 242 in a position which corresponds to its position on the cage 132 in the preferred embodiment.

In use and operation this alternative embodiment is utilized in the following manner. The vehicle 10 is positioned in a manner similar to that described in the preferred embodiment. The central scaffold 210 is then boarded by one or more operators. Once the vehicle is in position between two trees of an orchard row, the operator or operators may elevate or lower the scaffold frame 220, along arrow B, to a desired position. The operator or operators may then adjust the cage 242 or cage 252 horizontally, along arrow A, to a desired location. Once this position is achieved, pruning and other maintenance may be performed by the operator or operators. If a single operator is aboard, that operator may move between cages 242, 252 to perform similar maintenance or pruning. The operator may then return to the cage 242 to operate the joystick 66 to move the vehicle 10 to the next set of trees along the orchard row.

Figure 13:
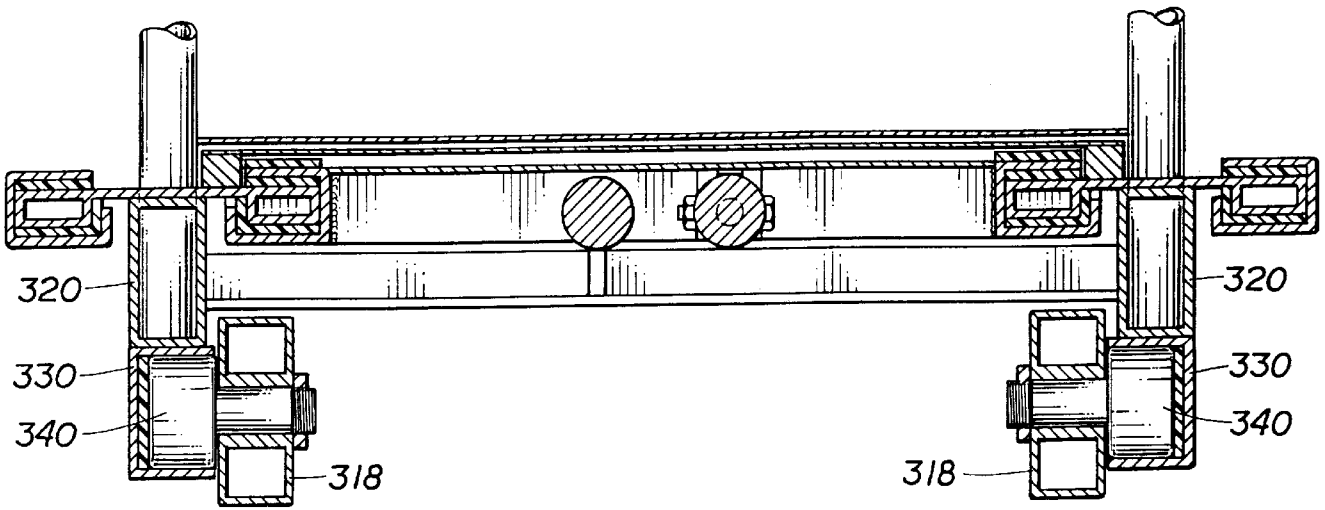
FIG. 13 is a cut away sectional view of that which is shown in FIG. 14 taken along lines 13—13.
Figure 14:
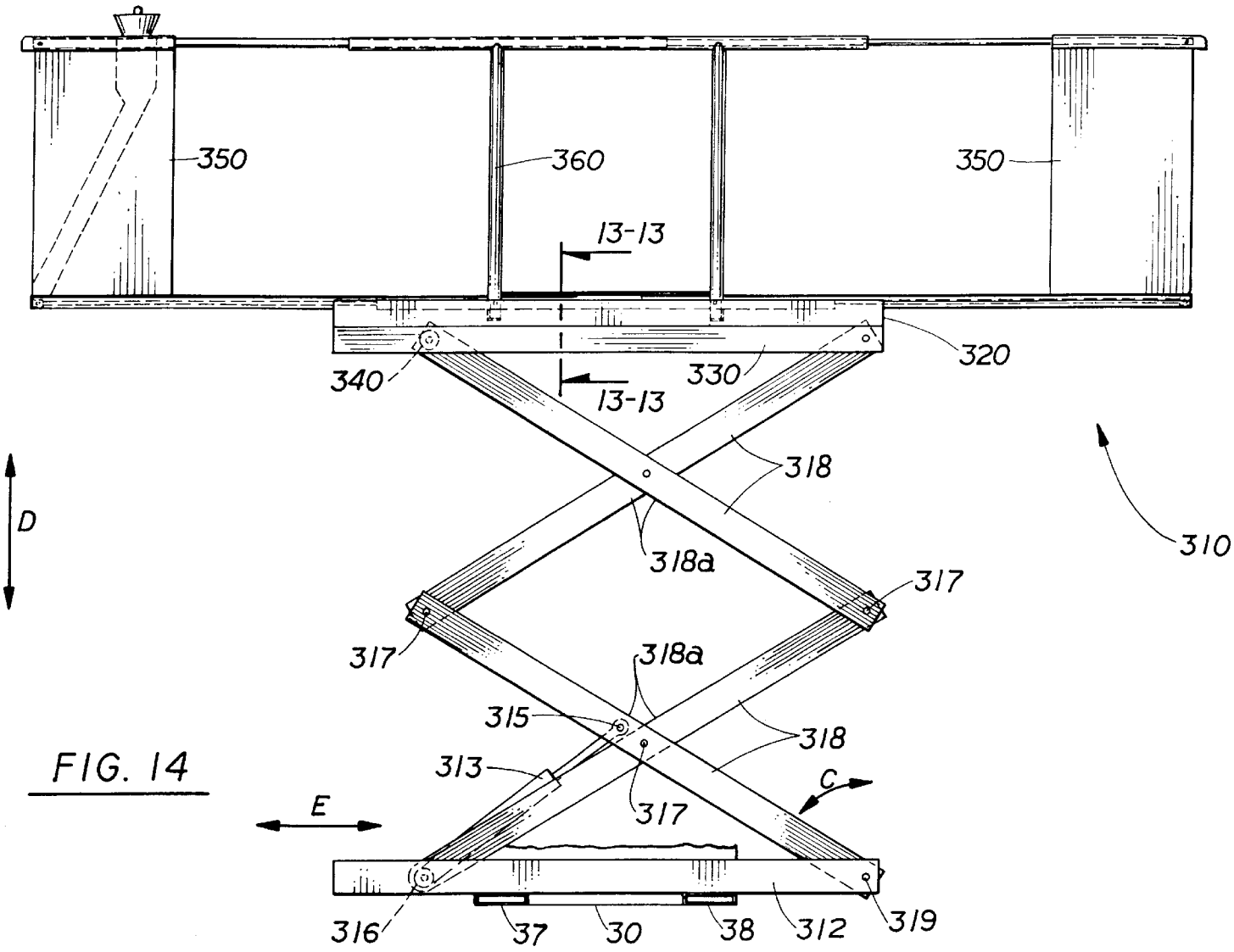
FIG. 14 is a right side view of another alternative embodiment of a portion of the device of this invention.

Another alternative embodiment, shown in FIGS. 13 and 14, involves replacement of the central scaffold 210 with a scissor scaffold 310. The scaffold 310 utilizes a scissor scaffold frame 320 which replaces the scaffold frame 220 of the central scaffold 210. The scaffold 310 attaches to the frame 30 of the vehicle 10 (i.e. at the central structure 36) above box beams 37,38. The scissor scaffold 310 has identical forward and rearward construction. FIG. 14 shows only the rearward portion of the scissor scaffold 310 but is representative of the forward portion.

A forward base guide 312 and a rearward base guide (not shown) of complemental construction are fixed transverse to the box beams 37, 38 in a horizontal orientation perpendicular to vehicle 10 motion. Each guide 312 is a linear rigid construct which has an inner race upon which guide wheels 316 may roll. Also each base guide 312, has a pivot pin assembly 319 located on right side ends of the base guide 312.

Pivotably attached to both the forward and rearward assemblies 319 are two scissor links 318. Each link 318 is pivotably connected to each guide 312 allowing rotation of link 318 without linear translation. Another pair of identical scissor links 318 are pivotably attached to the first links 318 at central locations 318*a* of each link 318 midway between distal ends thereof. A lower end of the second pair of links 318 is pivotably attached to the wheels 316 in a manner such that the wheels 316 restrict lower ends of the links 318 within the guides 312. Thus, the pair of links 318 form a lower "X"-shaped scissor, pivotable about the junction between the two links 318. An upper "X"-shaped scissor is pivotably attached to the lower "X"-shaped scissor. Upper ends of all four of the links 318 of the lower "X"-shaped scissor are pivotably attached to lower ends of other similar scissor links 318 of the upper "X"-shaped scissor. Each pivotable connection between links 318 is formed by a pivot pin assembly 317 similar to the assembly 111 of the preferred embodiment. Upper ends of the links 318 of the upper "X"-shaped scissor have either a pivotable attachment to a guide wheel 340 if on a left side or a pivotable attachment to a guide 330 if on the right side. The guides 330 provide races for the wheels 340 and are fixedly attached to a lower surface of the scaffold 310. While only an upper and a lower "X"-shaped scissor are shown in FIG. 14, it is contemplated that any number of "X"-shaped scissors could be interposed between the chassis 20 and the base guide 312.

A lifting ram 313 is pivotably connected between one of the guides 312 and one of the lower links 318 at a point 315 slightly above the pivot 317 which links the lower links 318 together. When the ram 313 is extended it causes the links 318 to pivot (along arrow C, for example) from a substantially horizontal extended position to a more vertical extended position. This in turn causes the scaffold frame 320 to raise to an elevated position (along arrow D). The wheels 316 roll within the guides 312 along arrow E, and within the two guides 330 located on a lower side of the frame 320. The frame 320 is similar in design to the scaffold frame 220 except that it is fixedly attached to the guide 330 instead of to the guides 216 of the central scaffold 210 embodiment.

A scissor scaffold handrail 360 is fixedly attached to the frame 320 and cages 350 are located at left and right ends of the frame 320. The locations of the cages 350 are adjustable in a manner similar to the adjustment of the central scaffold 210. The scaffold 310 only differs from the central scaffold 210 in that it utilizes a different structure to adjust the elevation of the scaffolds 210, 310. The horizontal adjustment of the cages 242, 252, 350 are not changed and therefore will not be belabored.

Figure 15:
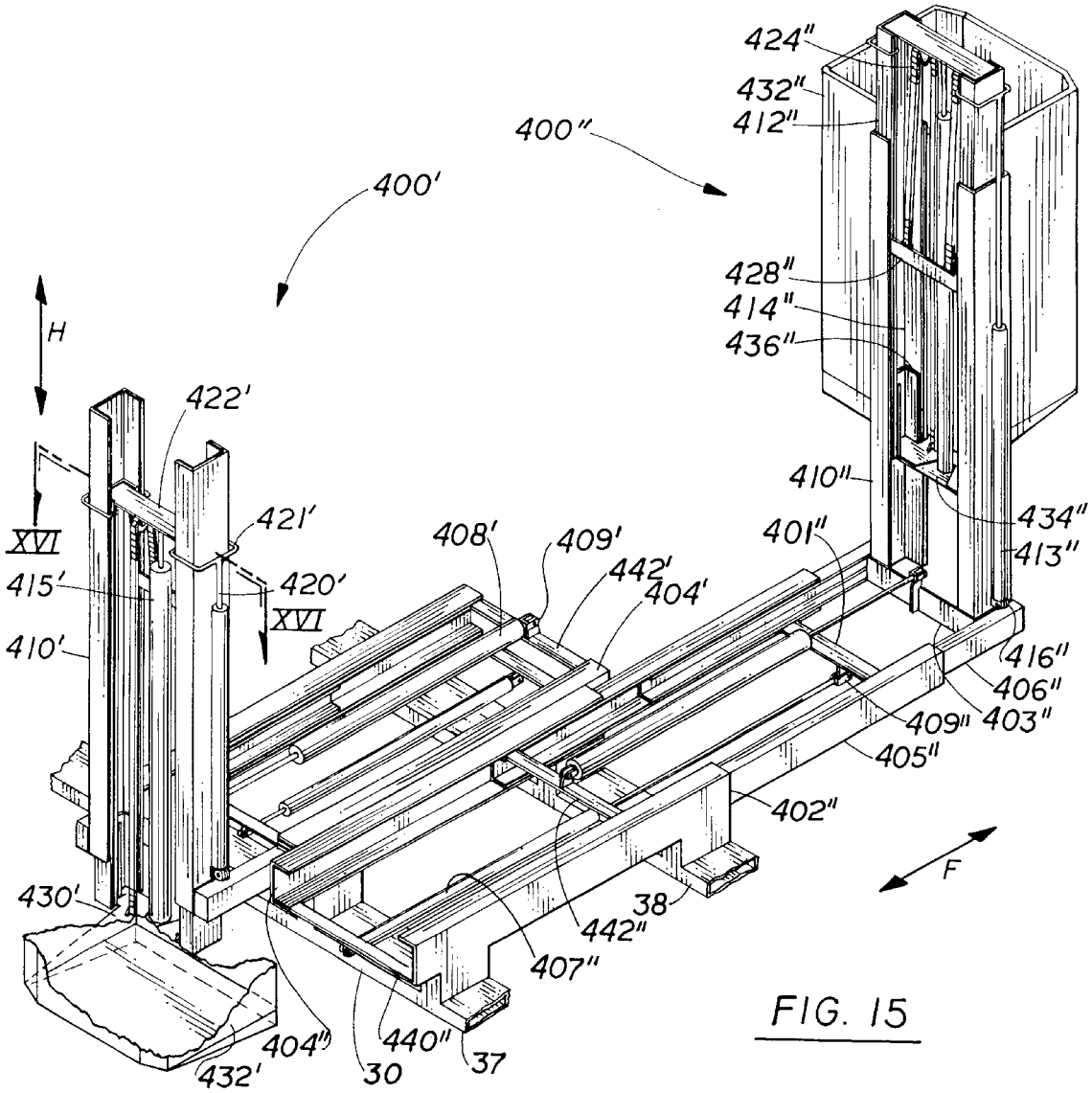
FIG. 15 is an isometric view of another alternative embodiment of a portion of the device of this invention.
Figure 16:
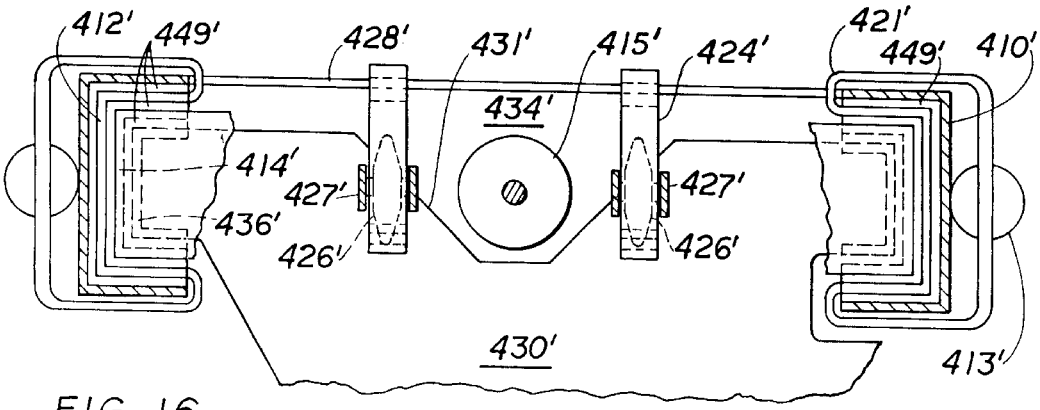
FIG. 16 is a cross-section of a portion of that which is shown in FIG. 15 taken along lines 16—16.
Figure 17:
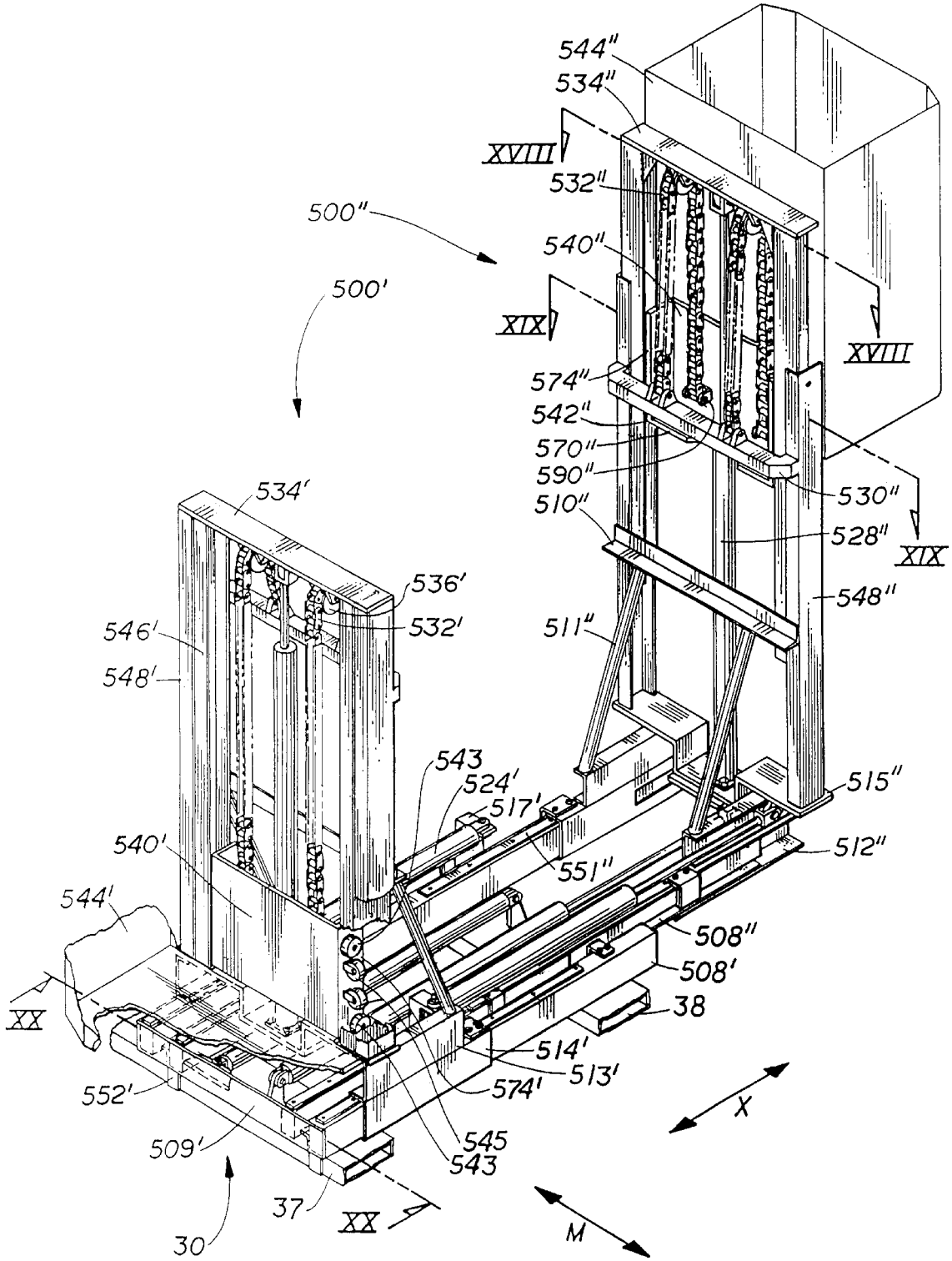
FIG. 17 is an isometric view of another alternative embodiment of a portion of the device of this invention.
Figure 18:
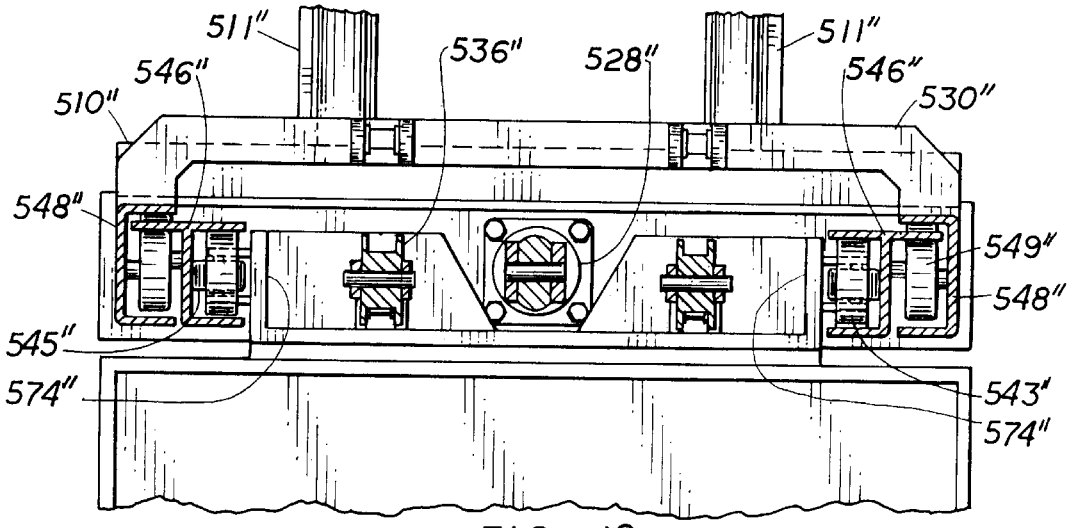
FIG. 18 is a cross-section of a portion of that which is shown in FIG. 17 taken along lines 18—18.
Figure 19:
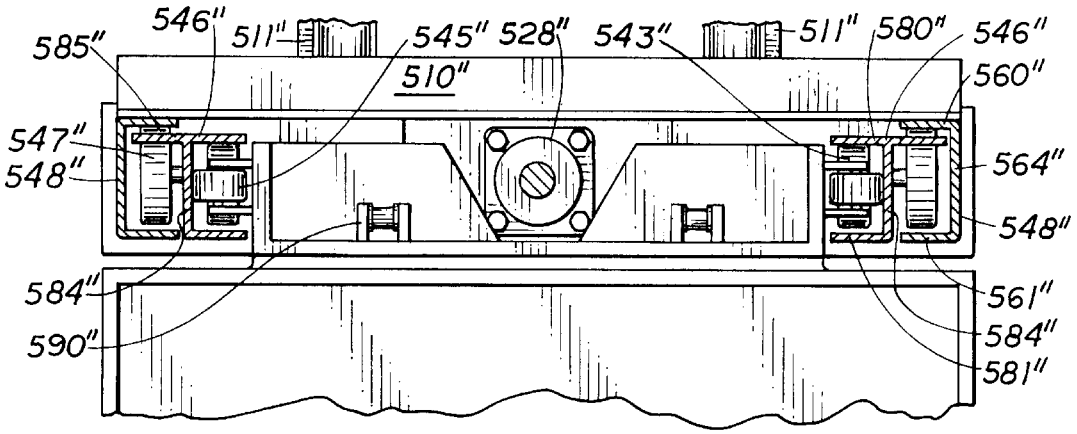
FIG. 19 is a cross-section of a portion of that which is shown in FIG. 17 taken along lines 19—19.

Referring now to FIGS. 15 and 16 another alternative embodiment of the pruning vehicle is shown. The scaffolds 100 of the preferred embodiment are replaced with scaffolds 400.

Both the left side and right side of the scaffold 400 operate similarly and will be discussed together with the left side showing the contracted position and the right side expanded.

Essentially, horizontal expansion occurs through multiple stages: two stages are illustrated. Each cage 432 is attached, through vertical expansion stages, to an outer stage formed with two slides 406 braced at ends thereof and which ride in guides 406 which have facing "C"-shaped channels to accommodate the slides 406.

In turn, these guides 406 have outer faces which define slides that run in outer guides 402, 404 and define the inner stage. As should now be evident, other stages could be similarly employed.

More specifically, each scaffold 400 of the pruning vehicle 10 connects to the chassis 20 through the central structure 36 of the frame 30. Two horizontal guides 402 are fixedly attached to an upper surface of the box beams 37, 38. The guides 402 are rigid members of substantially "C"-shaped cross-section which extend, along arrow F, across opposite sides of the frame 30 with open portions facing each other. Central guide 404 is located between the guides 402 at a location near a center of the central structure 36. The central guide 404 has an "I"-shaped cross-section with open sides of its "I"-shaped cross-section facing forward and rearward. Thus, two tracks are formed, one for each scaffold 400. A cross-bar 440 is fixedly attached between lower ends of each pair of guides 402, 404 on ends opposite their associated cages 432.

Two outer slides 405 are formed from two elongate channels of "C"-shaped cross-section and are oriented to nest within each track formed by the guides 402, 404. The slides 405 are of an exterior height substantially equal to the interior height of the "C"-shaped cross sections of the guides 402, 404. The slides 405 are of substantially the same length as the width of the frame 30. Cross-bars 442 are nested within cross-bar 440 and extend between forward and rearward sides of ends of the slides 405 distant from their associated cages 432 to hold them in a parallel configuration.

Having this shape, the slides 405 fit between the guides 402, 404 and are securely restricted from vertical motion and horizontal motion in the direction of vehicle 10 motion, but are allowed to slide freely horizontally, along arrow F, perpendicular to the direction of vehicle 10 motion. Each slide 405 has an outer end 401 comprised of a cross-bar extending between forward and rearward sides of each slide 405.

Hydraulic rams 407 are interposed between each of the cross-bars 440 and the outer ends 401. The rams 407 attach to the left ends 401 and cross-bars 440 through attachment brackets 409. Each attachment bracket 409 allows the ram 407 to pivot somewhat but restricts ends of the ram 407 from translation. When the rams 407 are extended, the slides 405 slide through the guides 402, 404 and are extended horizontally along arrow F. When the rams 407 are contracted, the slides 405 are returned to their positions closer to sides of the frame 30.

Inner slides 406 reside between each forward and rearward side of each slide 405. The inner slides 406 are of an exterior height equal to the interior height of each "C"-shaped cross-sections of sides of the outer slides 406. The inner slides 406 are substantially the same length as is the width of the frame 30. The inner slides 406 have outer ends 403 comprised of cross-bars extending between forward and rearward sides of the inner slides 406. Cross-bars 442 are interposed between the two portions of each inner slide 406, maintaining them in a parallel configuration.

Having this shape, the inner slides 406 fit within the outer slides 405 and are securely restricted from vertical motion and horizontal motion in the direction of vehicle 10 motion, but are allowed to slide freely horizontally, along arrow F.

Hydraulic rams 408 are interposed between the cross-bars 442 and the outer ends 403. The rams 408 attach to the inner slides 406 through additional attachment brackets 409. When one of the rams 408 is extended, the inner slide 406 is caused to slide through the sides of the outer slide 405 and is extended horizontally along arrow F. When the ram 408 is contracted, the inner slide 406 is returned to its original position within the outer slide 405.

A vertical guide 410 is fixedly attached to and extends above each outer end 403. The guides 410 are rigid elongate structures comprised of two channels of substantially "C"-shaped cross-section. The guide channels' open sides face each other.

An outer slide 412 is located within openings in the "C"-shaped channels of each guide 410. The slides 412 are sized with a thickness and width allowing them to fit snugly within the adjacent guides 410. Thus, the slides 412 are restricted from any horizontal motion.

The slides 412 are composed of two channels of "C"-shaped cross-section which have open sides facing each other. The slides 412 are substantially similar in length to the length of the guides 410. A chain attachment bar 428 is fixedly attached between the two channels of each slide 412 on a side closest to the frame 30. A bottom plate 434 is fixedly attached to lower surfaces of channels of each slide 412.

Two hydraulic rams 413 are interposed between each outer end 403 and an upper end of the adjacent slide 412. The rams 413 attach to the outer ends 403 through attachment brackets 416. The rams 413 attach to the slides 412 through ram attachments 420.

The ram attachments 420 are rigid constructs having two fingers 421. Each finger 421 reaches around the outer surface of the guide 410 from a location away from the guide 410 channel interior to a location inside the channel interior where the finger 421 fixedly attaches to the slide 412. One finger 421 goes around each side of each guide 410 channel.

Thus, when a pair of rams 413 are extended, the slide 412 is raised upwards along arrow H. When the rams 413 are contracted, the associated slide 412 is lowered. The rams 413 are sized and oriented to allow each slide 412 to be lowered below a bottom of each guide 410.

An inner slide 414 is located within openings in the "C"-shaped channels of each outer slide 412. The inner slides 414 are sized with a thickness and width allowing them to fit snugly within the associated outer slide 412. Thus, the inner slides 414 are restricted from any horizontal motion.

The inner slides 414 are composed of two channels of "C"-shaped cross-section which have open sides facing each other. The inner slides 414 are substantially similar in length to the length of the guides 410. Top plates 422 are fixedly attached between upper surfaces of the two channels comprising each inner slide 414.

Hydraulic rams 415 are interposed between an upper surface of each bottom plate 434 and a lower surface of each top plate 422. The rams 415 attach to the bottom plates 434 and the top plates 422 through attachment brackets 416.

When one of the rams 415 is extended, the associated inner slide 414 (among other parts, as will be explained) is caused to slide through the channels of the outer slide 412 and is extended upwards vertically along arrow H. When the ram 415 is contracted the inner slide 414 is extended downwards along arrow H.

A platform slide 436 is located within openings in the "C"-shaped channels of each inner slide 414. Each platform slide 436 is sized with a thickness and width allowing it to fit snugly within the associated inner slide 414. Thus, the platform slide 436 is restricted from any horizontal motion.

A lubricating layer 449 is interposed between each guide 410, outer slide 412, inner slide 414, and platform slide 436.

The lubricating layer 449 is similar to the lubricating layer 107 of the preferred embodiment. One alternative lubricating layer 449 includes use of thin solid hydrocarbon layers made from materials known for their low friction characteristics.

On a bottom end of each platform slide 436 is fixedly attached a platform 430. The platforms 430 are rigid constructs which extend horizontally across the bottom ends of the platform slides 436 and have contours which allow the platforms 430 to avoid contacting the associated rams 415.

A plurality of sprocket mounts 427 are fixedly attached to a lower surface of each top plate 422. Sprockets 426 are pivotably attached to the sprocket mounts 427. Chains 424 are located over each of the sprockets 426. Each chain 424 is attached on a first end to one of the chain attachment bars 428. Each chain 424 is attached on a second end to one of the platforms 430 on an upper surface thereof.

Thus, when one of the rams 415 is extended, the distance between the sprockets 426 and the chain attachment bar 428 is increased causing the chains 424 to raise the platform 430 upwards, along arrow H, with respect to the inner slide 414.

The cage 432 which corresponds to the cage 132 of the preferred embodiment is fixedly attached to the platform 430.

In use and operation, the platform 430 operates in the following manner. Users board the cages 432 of each scaffold 400 with none of the hydraulic rams 407, 408, 413, 415 extended. When one of the users desires to move a cage 432 horizontally outwards, along arrow F, the rams 407, 408 are extended causing the slides 405, 406 to more outward. When the user desires to move the cage 432 vertically upwards, along arrow H, the rams 413, 415 are extended causing the slides 412, 414, 436 to move upward. When the user desires to move the cage 432 vertically downwards, the rams 407, 408 are first extended somewhat, then the ram 413 is contracted causing the cage 432 to move downward.

While this embodiment includes four vertically nested supports for the cage 432, a variety of greater or lesser groupings of supports could be utilized. Alternatively, a series of horizontally nested supports could be utilized.

Referring now to FIGS. 17 through 21, another alternative embodiment of the scaffolds 100 are shown. In essence, two lifts 500 position two cages 544 which are independently horizontally and vertically translatable by means of telescoping slides (horizontally) and by a hydraulic ram coupled with a chain/sheave arrangement (vertically).

The left side of this embodiment is shown in a retracted configuration, while the right side of this embodiment is shown in an extended configuration. The two lifts 500 are substantially mirror images of each other and hence details of each side will be described together. As shown in FIGS. 17 through 21, the left side details are referred to with (') and the right side details are referred to with (").

Each lift 500 connects to the frame 30 (FIG. 2) at the central structure 36 (FIG. 2) thereof. Specifically, two outside rails 504 and two inside rails 554 are oriented across box beams 37, 38 and perpendicular to box beams 37, 38 on extreme forward and rearward portions of upper surfaces thereof. Each rail 504, 554 is an elongate rigid construct of orthorhombic shape which is fixedly attached to a support plate 503, 505 (FIG. 20) which is in turn fixedly attached to box beams 37, 38 of the central structure 36 and elevated therefrom through risers 552. One support plate 503 is rearward of the other support plate 505 with respect to the vehicle's front and rear.

An inner slide 508 of "C"-shaped cross-section conforms to outer contours of each outside rail 504 and each inside rail 554. Each inner slide 508 has: a top shelf 568 resting above each rail 504, 554; an intermediate wall 572 resting along an outside edge of the outside rail 504 or an inside edge of the inside rail 554; and a bottom shelf 576 adjacent a bottom side of the rail 504, 554. A lubrication layer 551 is interposed between each inner slide 508 and each rail 504, 554. A lip 507 extends down from an end of the top shelf 568 along an upper portion of each inner slide 508; an inner side of each outside rail 504; and an outer side of each inside rail 554. This lip 507 keeps the slide 508 on track upon the rail 504 and prevents the inner slide 508 from translating horizontally along the direction of vehicle motion M.

An end plate 509 (FIG. 17) seals by attachment to ends of the inner slides 508. One end plate 509 is oriented in a vertical plane and holds the two inner slides 508, which slide over the outside rails 504 together. The other end plate 509 is oriented in a horizontal plane and holds the two inner slides 508, which slide over the inside rails 554 together. The outside rails 504 support the left lift 500 and the inside rails 554 support the right lift 500. The left lift 500 and right lift 500 are identical except for their attachment to different rails 504, 554. First rams 520 are interposed between each box beam 37, 38 and one of the end plates 509 with pivotable attachments at ends of the first rams 520. Thus, when one of the first rams 520 is extended, the associated end plate 509 is caused to move with respect to the chassis 20. This in turn causes one set of inner slides 508 to slide along arrow X.

Two outer slides 512 are shaped to conform to surfaces of each inner slide 508 of each rail 504, 554. Each slide 512 has an upper portion 513 and a lower portion 514. The upper portions 513 act as risers extending above each lower portion 514. The lower portions 514 are "C"-shaped and similar in construction to the inner slides 508. However, the lower portions 514 are sized with inner dimensions slightly larger than outside dimensions of the inner slides 508 to facilitate their nesting together over the rails 504, 554. A gap, formed between each inner slide 508 and the associated outer slide 512, may be supplied with a lubricant 551 to facilitate relative movement therebetween.

Figure 20:
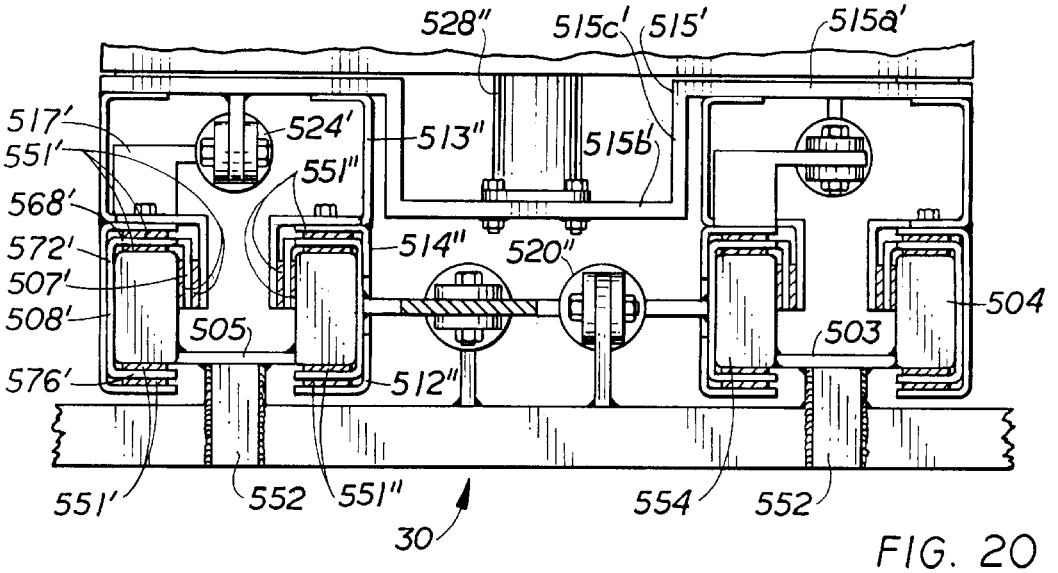
FIG. 20 is a cross-section of a portion of that which is shown in FIG. 17 taken along lines 20—20.
Figure 21:
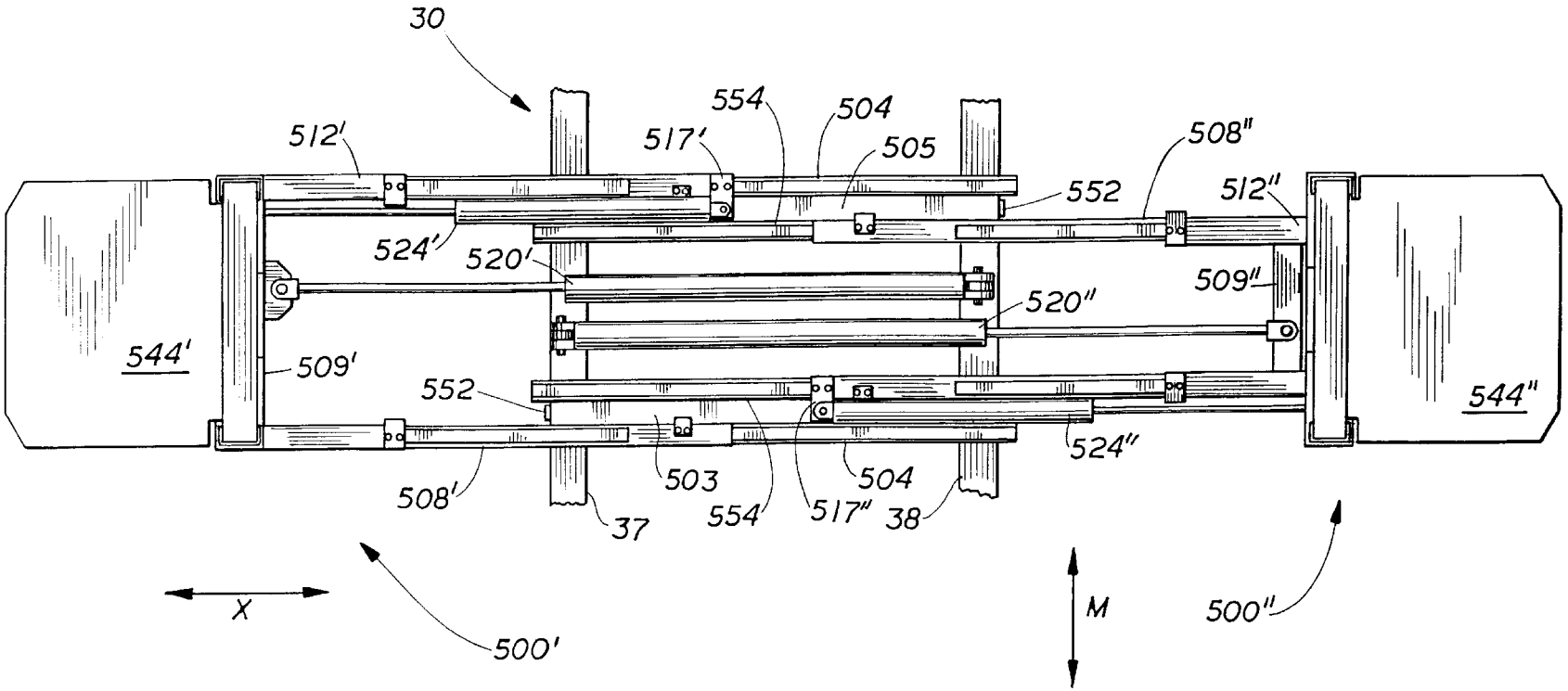
FIG. 21 is a top plan view of that which is shown in FIG. 17.

A tie 515 extends between and unites each upper portion 513 of each outer slide 512 of each lift 500 so that they move in unison. The ties 515 are rigid constructs of constant narrow width having two horizontally extending opposing ends 515*a*. A central portion 515*b* of each tie 515 has vertically downward extending portions 515*c* which join the central portion 515*b* to the ends 515*a*. Thus, as shown in FIG. 20, the ties 515 have an inverted "top hat"-like cross-section.

An "L"-bracket 517 is fixedly attached to each of the inner slides 508 and supports one end of a second ram 524 which is also connected to the tie 515 and to the associated outer slide 512. The "L"-brackets 517 are rigid constructs which extend vertically above the inner slides 508, and horizontally towards the risers 552, a short distance. The lower portions of the "L"-brackets 517 are preferably located on the inner slides 508 on ends thereof distant from the associated ties 515.

The second rams 524 facilitate relative motion between the outer slides 512 and the inner slides 508. In use and operation, the rails 504, 554 support the inner slides 508 such that when one of the first rams 520 is extended or contracted, the inner slides 508 move relative to the rails 504, 554. Likewise, when the second rams 524 are extended or contracted the outer slides 512 are caused to move with respect to the inner slides 508. Extension of both the first ram 520 and the second ram 524 of either lift 500 causes the associated outer slide 512 to be displaced even more distant from the central structure 36 of the frame 30 along arrow X than would be possible through action of either ram 520 or ram 524 alone.

A vertical translation portion of each lift 500 is now described which attaches to an upper surface of each tie 515. The vertical translation portion of each lift 500 is a mirror image of the opposite lift 500 and includes the following details generic to each lift 500.

Each lift 500 has two "C"-rails 548 which are fixedly attached to an upper surface of each tie 515 at forwardmost and rearwardmost portions thereof. Each "C"-rail 548 is a rigid elongate construct having a "C"-shaped cross-section. Specifically, each "C"-rail 548 has a first wall 560 parallel to and spaced from a second wall 561. The first wall 560 is near to a center of the frame 30 than is the second wall 561. An orthogonal wall 564 extends from one end of the first wall 560 to one end of the second wall 561. An open portion of each "C"-rail 548 is defined by the walls 560, 561, 564. Open portions of each pair of "C"-rails 548 face each other and the central portion 515*b* of each tie 515.

The pairs of "C"-rails 548 are united by support cross-bars 510 formed from angle iron. The support cross-bars 510 are rigid elongate constructs of "L"-shaped cross-section which are oriented horizontally, along arrow M, and are fixedly attached between each pair of "C"-rails 548 on sides thereof closest to a center of the frame 30. Two diagonal supports 511 are interposed between each support crossbar 510 and upper surfaces of each of the upper portions 513 at ends distant from the box beams 37, 38. The support crossbars 510 and diagonal supports 511 provide additional rigidity to each pair of "C"-rails 548.

A chain crossbar 530 is also interposed between each pair of "C"-rails 548. Each chain crossbar 530 is an elongate rigid construct of rectangular cross-section which is fixedly attached at distant ends thereof to each "C"-rail 548. The chain crossbars 530 are located above the support crossbars 510. The chain crossbars 530 extend somewhat horizontally away from the two pairs of "C"-rails 548 and closer to a center of the frame 30. The chain crossbars 530 provide additional support for the pairs of "C"-rails 548 as well as other functions which will become apparent.

Two pairs of "J"-rails 546 are interposed between each pair of "C"-rails 548 with one "J"-rail 546 adjacent to each "C"-rail 548. Thus, each "J"-rail 546 and each "C"-rail 548 resides in a plane which is substantially vertical and extends parallel to arrow M. Each "J"-rail 546 has a "J"-shaped cross-section. Specifically, each "J"-rail 546 is a rigid elongate construct of uniform cross-section. A long wall 580 and a short wall 581 are oriented parallel to each other. A perpendicular wall 584 extends between the long wall 580 and the short wall 584 and is securely attached therebetween. The perpendicular wall 584 extends from a center of the long wall 580 to an end of the short wall 581.

Each "J"-rail 546 is nested within the adjacent "C"-rail 548 such that the long wall 580 of each "J"-rail 546 extends into the open portion of the associated "C"-rail 548 with the long wall 580 parallel to and slightly spaced from the first wall 560. This orientation locates the short wall 581 in a plane parallel to the second wall 561 of the "C"-rail 548.

A "C"-rail wheel 549 is located within the open portion of each "C"-rail 548 on an uppermost end thereof. The "C"-rail wheels 549 are cylindrical constructs which have an axle which allows the wheels to rotate within each "C"-rail 548 without translation linearly. Each "C"-rail wheel 549 has a diameter with sufficient clearance between the first wall 560 of the "C"-rail 548 and a radial edge of the "C"-rail wheel 549 to receive the long wall 580 of the "J"-rail 546 therebetween. Each long wall 580 is in contact with each "C"-rail wheel 549.

Each "J"-rail 546 has a "J"-rail wheel 547 on a lower portion thereof which is rotatably connected to the perpendicular wall 584 of each "J"-rail 546. The "J"-rail wheels 547 are aligned with the "C"-rail wheels 549 such that they both rotate within the same plane. However, the "J"-rail wheels 547 are displaced such that they are slightly closer to the first wall 560 than are the "C"-rail wheels 549. A hole (not shown) is formed in the long parallel portion of each "J"-rail 546 to allow the "J"-rail wheels 547 to have a point of tangency which extends therebeyond. Thus, when each "J"-rail 546 is nested within each "C"-rail 548, each long wall 580is adjacent the associated "C"-rail wheel 549 on an upper portion of each "C"-rail 548. Also, each "J"-rail wheel 547 is tangentially registered against the first wall 560 on a lower portion of each "C"-rail 548.

Portions of each lift 500 above the outer slide 512 have a center of mass which is farther from a center of the frame 30 than are the "C"-rails 548. Thus, a torque is created which causes the "J"-rail 546 to exert a force against the "C"-rail wheels 549 and causes the "J"-rail wheels 547 to exert a force against the "C"-rails 548 as a couple. The wheels 547, 549 support the "J"-rails 546 such that the "J"-rails 546 can be translated vertically by rolling within the "C"-rails 548.

Each pair of "J"-rails 546 are spaced a distance apart on upper surfaces thereof by top plates 534. The top plates 534 are flat rigid elongate constructs which have a length equal to a distance between each two "C"-rails 548 and are fixedly attached to upper edges of each "J"-rail 546 pair. The top plates 534 maintain the two "J"-rails 546 of each pair sufficiently distant from each other that they cannot be displaced from within the "C"-rail 548 pairs.

A trolley 542 is located between each pair of "J"-rails 546. Each trolley 542 includes a bottom plate 570 and two mutually parallel side plates 574 which extend perpendicularly upward from the bottom plate 570. A shield 540 also extends upward from the bottom plate 570 of each trolley 542 and are perpendicular to the side plates 574 of the trollies 542. Each shield 540 is on a side of the associated trolley 542 opposite from a center of the frame 30. Each shield 540 forms a larger surface than the plates 570, 574 of the trolley 542 two side plates 574 of each trolley 542 are spaced sufficiently apart and sized of a width so that they can slide within a portion of each pair of "J"-rails 546 opposite the "C"-rails 548. To facilitate movement therein, the side plates 574 of each trolley 542 have wheels thereon which allow the trollies 542 to roll within the "J"-rail 546 pairs.

Two first trolley wheels 543 are oriented on uppermost and lowermost edges of each of the side plates 574 of each trolley 542 with one of the first trolley wheels 543 on a lower portion thereof on a side nearer the frame 30 and the other of the first trolley wheels 543 located on an upper portion thereof on a side away from the frame 30. Each lower wheel 543 rolls against the long wall 580 of the associated "J"-rail 546. Each upper wheel 543 rolls against the short wall 581. Thus, the trollies 542 are prevented from jamming within the "J"-rails 546. Two second trolley wheels 545 are located on each side plate 574 of each trolley 542 and rolls along the perpendicular walls 584 of each "J"-rail 546. The second trolley wheels 545 keep the trolley 542 from rotating and jamming during movement relative to the "J"-rails 546.

Two sheaves 536 extend from a lower surface of each top plate 534 such that one sheave is inboard slightly from each "J"-rail 546. Each sheave 536 receives a chain 532 thereover. Each chain 532 is pivotably attached on one end to one of the chain crossbars 530 and on a second end to the shield 540. Alternatively, the sheaves 536 may be replaced with sprockets.

A vertical ram 528 is interposed between each central portion 515*b* of each tie 515 and each associated top plate 534. Thus, when one of the vertical rams 528 is extended, the adjacent top plate 534 is caused to be displaced upwards away from the associated tie 515. This in turn causes the associated "J"-rails 546, which are fixedly attached to the top plate 534, to be displaced upwards. This also causes the attached sheaves 534 to be displaced upwards. The chains 532 are displaced about the sheaves 534 with their first ends remaining fixed to the chain crossbar 530 which is grounded to the tie 515. The second end of each chain 532 which is attached to the shield 540 and hence to the trolley 542 causes the trolley 542 and shield 540 to roll upwards within the "J"-rails 546.

A cage 544 is fixedly attached to each shield 540 on a lower surface thereof. Each cage 544 is similar to the cage 132 of the preferred embodiment. Through activation of the first ram 520, second ram 524 and vertical ram 528, the cage 544 may be displaced horizontally and vertically to locate a user in the position desired for performing tree maintenance within an orchard.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically;

wherein two of said platforms include means to restrict platform motion so that said platforms are vertically adjustable along parallel offset axes lying in offset vertical planes perpendicularly intersecting the long axis of the frame wherein said horizontal platform movement means includes a rigid slide having a first end adjacent said means to move each said platform vertically and a second end opposite said first end coupled to a means to slideably support said slide, said slide support means coupled to said frame and a means to displace said slide horizontally relative to said frame.

2. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform vertically and perpendicular with respect to the ground, means to move each said platform horizontally in a direction perpendicular to said long axis independently of said means to move each said platform vertically, a plurality of nested telescoping horizontal slides capable of sliding horizontally perpendicular to said long axis of said frame, a plurality of nested telescoping vertical slides capable of sliding vertically fixedly attached to a distant end of a most distant said horizontal slide, a plurality of hydraulic rams interposed between adjacent slides to effect their relative motion, and a plurality of chains interposed between a most distant of said vertical slides attached to said platform and another of said slides through intervening sprockets attached to said another of said slides;

whereby said platform remains oriented horizontally with only linear translation ting place when said hydraulic rams are extended and contracted.

3. The vehicle of claim 2 wherein a means to separably control perpendicular movement and a means to separably control horizontal movement substantially perpendicular to said long axis are located on said platform such that an operator on said platform can separately adjust a position of said platform perpendicular to the ground and a horizontal position of said platform.

4. The vehicle of claim 2 wherein two of said platforms include means to restrict platform motion to common planes substantially perpendicular to said long axis and on opposite sides of said long axis, such that adjacent trees in opposite rows of the orchard can be simultaneously pruned.

5. The vehicle of claim 2 wherein said horizontal platform movement means includes a rigid slide having a first end adjacent said means to move each said platform vertically and a second end opposite said first end coupled to a means to slideably support said slide, said slide support means coupled to said frame and a means to displace said slide horizontally relative to said frame.

6. The vehicle of claim wherein at least one of said platforms includes a means to drive said vehicle within the orchard.

7. The vehicle of claim 2 wherein said horizontal platform movement means is interposed between said frame and said means to move each said platform vertically.

8. In an orchard, a pruning system comprising:

a vehicle including a frame and attached wheels, said frame including a leading edge and a trailing edge with a long axis extending from said leading edge to said trailing edge and a mid-section between said leading edge and said trailing edge, an engine upon said frame powering said pruning system vehicle, a multiple of two platforms located at said mid-section of said frame and oriented in balanced pairs in planes substantially perpendicular to said long axis so that said vehicle remains stable in use, each said platform including means to adjustably locate said platform with respect to said frame, means to operate each said platform locating means independently, whereby each said platform can service a tree simultaneously in an orchard where trees in adjacent rows are opposite each other and are not staggered, wherein rotation and steering of said wheels of said vehicle is controlled by controlling means located adjacent one of said platforms, and wherein a horizontal only platform control means and a vertical only platform control means are provided which are separate such that operation of said horizontal platform control means does not adjust a vertical position of said platform and operation of said vertical platform control means does not adjust a horizontal position of said platform, a plurality of nested telescoping horizontal slides capable of sliding horizontally perpendicular to said long axis of said frame, a plurality of nested telescoping vertical slides capable of sliding vertically fixedly attached to a distant end of a most distant said horizontal slide, a plurality of hydraulic rams interposed between adjacent slides to effect their relative motion, and a plurality of chains interposed between a most distant of said vertical slides attached to said platform and another of said slides through intervening sprockets attached to said another of said slides;

whereby said platform remains oriented horizontally with only linear translation taking place when said hydraulic rams are extended and contracted.

9. An orchard pruning vehicle, comprising, in combination:

a frame supporting said vehicle, said frame including a leading edge and a trailing edge with a long axis extending from said leading edge to said trailing edge and a mid-section intermediate between said leading edge and said trailing edge, wheels connected to said frame and supporting said frame above ground, an engine upon said frame imparting rotation to said wheels to move said vehicle along the ground, and a plurality of platforms, each said platform supported on said frame by a separate moveable connection means, each said moveable connection means including a means to move said supported platforms both vertically substantially perpendicularly to said long axis and horizontally substantially perpendicularly to said long axis, wherein said moveable connection means includes means to restrain said platforms from rotating relative to said frame;

whereby said platforms may be adjustably oriented in three distinct mutually perpendicular directions, through movement of said vehicle and adjustment of said moveable connection means, to locate a person on one of said platforms in a wide variety of positions for simplified tree maintenance, a plurality of nested telescoping horizontal slides capable of sliding horizontally perpendicular to said long axis of said frame, a plurality of nested telescoping vertical slides capable of sliding vertically fixedly attached to a distant end of a most distant said horizontal slide, a plurality of hydraulic rams interposed between adjacent slides to effect their relative motion, and a plurality of chains interposed between a most distant of said vertical slides attached to said platform and another of said slides through intervening sprockets attached to said another of said slides;

whereby said platform remains oriented horizontally with only linear translation taking place when said hydraulic rams are extended and contracted.

10. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically, a plurality of nested telescoping horizontal slides capable of sliding horizontally perpendicular to said long axis of said frame, a plurality of nested telescoping vertical slides capable of sliding vertically fixedly attached to a distant end of a most distant said horizontal slide, a plurality of hydraulic rams interposed between adjacent slides to effect their relative motion, and a plurality of chains interposed between a most distant of said vertical slides attached to said platform and another of said slides through intervening sprockets attached to said another of said slides;

whereby said platform remains oriented horizontally with only linear translation taking place when said hydraulic rams are extended and contracted.

11. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically, a horizontal extension means adjusting said platform's location along a horizontal line orthogonal said long axis of said frame, and a vertical extension means adjusting said platform's location vertically;

said horizontal extension means comprised of nested hydraulically activated rigid supports grounded to said frame and said vertical extension means comprised of both nested hydraulically activated rigid supports and chains interposed between rigid supports and pivoting about rotational supports attached to said rigid supports such that a mechanical advantage is affected, said vertical extension means grounded to an end of said horizontal extension means distant from said frame;

whereby said platform remains oriented horizontally with only linear translation taking place when said hydraulically activated rigid supports are extended or contracted.

12. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically;

wherein two of said platforms include means to restrict platform motion so that said platforms are vertically adjustable along parallel offset axes lying in offset vertical planes perpendicularly intersecting the long axis of the frame;

wherein said horizontal platform movement means includes a rigid slide having a first end adjacent said means to move each said platform vertically and a second end opposite said first end coupled to a means to slideably support said slide, said slide support means coupled to said frame and a means to displace said said horizontally relative to said frame.

13. The vehicle of claim 12 wherein a means to separably control perpendicular movement and a means to separably control horizontal movement substantially perpendicular to said long axis are located on said platform such that an operator on said platform can separately adjust a position of said platform perpendicular to the ground and a horizontal position of said platform.

14. A vehicle for simultaneously pruning trees oriented along two parallel rows of trees extending above ground in an orchard, the vehicle comprising in combination:

a fame, said frame including a leading edge and a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically;

wherein said horizontal platform movement means is interposed between said frame and said means to move each platform vertically;

wherein at least one of said platforms includes a means to drive said vehicle within the orchard.

15. The vehicle of claim 14 wherein a means to separably control perpendicular movement and a means to separably control horizontal movement substantially perpendicular to said long axis are located on said platform such that an operator on said platform can separately adjust a position of said platform perpendicular to the ground and a horizontal position of said platform.

16. The vehicle of claims wherein a means to separably control perpendicular movement and a means to separably control horizontal movement substantially perpendicular to said long axis are located on said platform such that an operator on said platform can separately adjust a position of said platform perpendicular to the ground and a horizontal position of said platform.

17. The vehicle of claim 14 wherein said means to move said vehicle is a joystick operatively coupled to said wheels and an engine on said vehicle.

18. The vehicle of claim 14 wherein rotation of said wheels of said vehicle is controlled by controlling means located on one of said platforms, whereby need for a person off of said platforms to drive the vehicle is avoided.

19. A vehicle for simultaneously pruning trees oriented along two parallel rows of trees extending above ground in an orchard, the vehicle comprising in combination:

a frame, said frame including a leading edge and a trailing edge with a long axis extending from said leading edge to said trailing edge and a mid-section between said leading edge and said trailing edge, wheels coupled to said frame and supporting said frame above ground, at least two platforms, each said platform moveably connected to said mid-section of said frame, means to move each said platform in a pure linear vertical direction and perpendicular with respect to the ground, and means to move each said platform in a pure linear horizontal direction perpendicular to said long axis independently of said means to move each said platform vertically;

wherein two of said platforms include means to restrict platform motion so that said platforms are vertically adjustable along parallel offset axes lying in offset vertical planes perpendicularly intersecting the long axis of the frame wherein said horizontal platform movement means is interposed between said frame and said means to move each said platform vertically.

20. The vehicle of claim 19 wherein a means to separably control perpendicular movement and a means to separably control horizontal movement substantially perpendicular to said long axis are located on said platform such that an operator on said platform can separately adjust a position of said platform perpendicular to the ground and a horizontal position of said platform.

21. The vehicle of claim 19 wherein at least one of said platforms includes a means to operate said vehicle within the orchard.

* * * * *